US005436027A

United States Patent [19]

Offer

[11] Patent Number: 5,436,027

[45] Date of Patent: Jul. 25, 1995

[54] METHOD OF APPLYING A COATING DESIGN

[75] Inventor: Brad W. Offer, Lynnwood, Wash.

[73] Assignee: The Boeing Company, Seattle, Wash.

[21] Appl. No.: 172,846

[22] Filed: Dec. 23, 1993

[51] Int. Cl.[6] ..... B05D 3/06

[52] U.S. Cl. ..... 427/10; 427/259; 427/264; 427/270; 427/272; 427/282; 427/385.5; 427/402; 427/555; 427/596

[58] Field of Search ..... 427/10, 555, 596, 270, 427/272, 282, 385.5, 259, 264, 402

[56] References Cited

U.S. PATENT DOCUMENTS

| | | | |
|---|---|---|---|
| 4,146,327 | 3/1979 | Harris | 356/1 |
| 4,358,482 | 11/1982 | Jubelt | 427/259 |
| 4,466,739 | 8/1984 | Kasner et al. | 356/138 |
| 4,468,414 | 8/1984 | Van Vonno | 427/53.1 |
| 4,523,973 | 6/1985 | Nelson | 156/626 |
| 4,532,402 | 7/1985 | Overbeck | 219/121 |
| 4,578,281 | 3/1986 | Ebisawa et al. | 427/53.1 |
| 4,791,267 | 12/1988 | Yokoyama et al. | 219/121.69 |
| 4,865,873 | 9/1989 | Cole, Jr. et al. | 427/53.1 |
| 4,874,239 | 10/1989 | Tamura | 356/4 |
| 4,886,704 | 12/1989 | Kamada et al. | 428/323 |

*Primary Examiner*—Bernard Pianalto
*Attorney, Agent, or Firm*—David P. Campbell

[57] ABSTRACT

A method and apparatus for applying a coating design to selected portions of a surface (13) of a structure (14) including the steps of applying a maskant (18) to the surface (13), positioning a plurality of sensors (20) on the structure (14) around the surface (13), positioning a laser (22) at a distance from the surface (13), directing a laser beam (32) from the laser (22) to each of the sensors (20) as input to the sensors, and using output from the sensors (20) based on the input to determine the position of the laser (22) relative to the surface (13), scanning the perimeter of the selected portions (36) with a laser beam (34), including using the determined relative positions of the laser and the surface to guide the laser beam, to cut into the maskant (18) around the perimeter, peeling the maskant (18) away from the selected portions (36), and applying the coating to the selected portions.

16 Claims, 8 Drawing Sheets

```
SCAN FILE 1
NUM REFS:        6
-9.2        23.4        2.7
5 MORE LINES FOR REFERENCE POINT COORDINATES
num POINTS: 347
num ENTITIES:  3
SQUARE:          100
-5.5        3.3        12.1
99 MORE LINES FOR ENDPOINT COORDINATES
FORMING A 3D SQUARE PATTERN
CIRCLE:          120
7.3         4.9        -10.2
119 MORE LINES FOR ENDPOINT COORDINATES
FORMING A 3D CIRCLE PATTERN
TRIANGLE:  127
-2.2        3.7        12.5
126 MORE LINES FOR ENDPOINT COORDINATES
FORMING A 3D TRIANGLE PATTERN
```

METHOD OF APPLYING A COATING DESIGN

TECHNICAL FIELD

This invention pertains to a method and apparatus for applying a coating to selected portions of a surface, such as by painting a design on the exterior surface of a structure, for example, airplanes, trucks, cars, boats, or the like. More particularly, the invention pertains to a method and apparatus for laser cutting a stencil pattern in a maskant applied to the surface in order to create a stencil for coating or painting designs on the surface.

BACKGROUND INFORMATION

Current methods of masking logos and other various shapes and designs for painting airplane exteriors involve hand measurements, sometimes assisted by mylar alignment tools, which measurements are used as guides for accurate placement of paper stencils, or "pre-masks," which have been pre-cut with the outline of the design that is to be painted. These pre-masks are then affixed by their adhesive backing to the skin of the airplane over the base-coat of paint (color $\pi 1$). Alternatively, the design may be formed by hand application of masking tape and butcher paper around the perimeter of the design. Again, this taping process may utilize hand measurements or may be aided by the use of mylar positioning and alignment tools. The second color (color #2) is then painted over the stencil which can then be removed. This process is repeated one or more times for multicolored designs.

There are a number of concerns with this current masking method. First, due to the bulkiness and size of many of the stencils and pre-masks, and the need for accurate placement, decorative masking is a difficult and time consuming job, sometimes requiring substantial rework. In the masking of airplanes, the problem is compounded in the paint hangers, at the end of the airplane's production cycle where flow time is most expensive. Second, the masking tape used to apply the pre-masks and stencils requires that the underlying base coat undergo a comparatively long cure time in order to avoid damage to the base coat when the tape is removed. The tape can also leave an adhesive residue that must be cleaned later. Third, full size templates and pre-masks must be created, maintained, and stored for each individual design. For airplane manufacturers, each airplane customer usually has a distinctive exterior decorative design, which is frequently updated. This requires a very large inventory of paper templates and pre-masks and creates a substantial logistics problem. Fourth, the current method does not lend itself to full implementation of all digital product design. Although templates and pre-masks can be (and currently are) cut using digital databases, any design iterations or other changes require creating and painting a whole new template to allow visualization of the new designs. The present invention is directed to a computerized laser masking method and apparatus that addresses these concerns.

DISCLOSURE OF THE INVENTION

Briefly described, the present invention comprises a method and apparatus for applying a coating design to selected portions of a surface of a structure, wherein the method includes the steps of applying a maskant to the surface, positioning a plurality of sensors on the structure around the surface, and positioning a laser at a distance from the surface. A laser beam from the laser then is directed to each of the sensors as input to the sensors, and output from the sensors based on the input is used to determine the position of the laser relative to the surface. The laser then scans the perimeter of the selected portions of the surface using the determined relative positions of the laser and the surface to guide its laser beam. As the laser scans the surface, the maskant is cut by the laser beam. The cut sections of the maskant then are peeled away from the selected portions of the surface and the coating is applied over the maskant and onto the selected portions.

The step of using output from the sensors based on the input to determine the position of the laser relative to the surface includes using the output from the sensors to determine the position of the sensors relative to the laser and determining the position of the surface relative to the position of the sensors.

The step of determining the position of the surface relative to the position of the sensors includes establishing reference point locations on the structure for the sensors, and creating a design map for the coating design, which design map establishes the position of the design map relative to the reference point locations. The design map corresponds to the contours of the selected portions of the surface so that upon placement of the sensors on the structure at the reference point locations, the position of the surface relative to the sensors is known.

The step of using output from the sensors based on the input to determine the position of the laser relative to the surface further includes the step of transforming the design map for the coating design from a design map relative to the reference point locations to a transformed design map relative to the laser.

Preferably, the step of determining the position of the laser relative to the position sensors includes performing an iterative resectioning analysis. For an alternative embodiment, the same step includes performing a range triangulation to determine the position of the sensors.

According to one aspect of the invention, the step of directing a laser beam is performed with a first laser, and the step of scanning the perimeter of the selected portions with a laser beam is performed with a second laser. The second laser is able to generate a more powerful laser beam than the first laser. A lower power first laser is used only for the position-sensing process and not for cutting the maskant and, thus, is safer to use than the high power cutting laser.

Preferably, the maskant is adapted to adhere to the surface, yet be peelable from the surface, and to absorb substantially all of the laser beam energy so as to avoid damaging the surface of the structure. A suitable maskant material is sold under the trade name "SPRAYLAT" SC-1071B, which is a water based black pigmented strippable coating material.

Preferably, the laser is substantially mobile so that the laser can be maneuvered about the structure and positioned so that the laser confronts the surface of the structure. With a movable laser, positioning flexibility is achieved and the relative positions of the laser and the structure do not have to be precisely fixed.

The laser masking system of the present invention includes a plurality of sensors for placement on the structure around the surface, a laser for positioning a distance from the surface, and a control system for directing a laser beam from the laser at each sensor as input to the sensor, and for receiving output from the sensors based on the input to determine the position of the laser relative to the surface. The control system is adapted to direct a laser beam from the laser into the maskant to cut a pattern in the maskant. The control system uses the determined relative positions of the laser and the surface to guide the laser beam. After the maskant is cut by the laser beam, cut sections of maskant can be peeled away from the surface to create a stencil on the surface of the structure.

The control system includes a position-sensing program for determining the position of the sensors relative to the laser. The control system receives a data file for the coordinates of the pattern, and is adapted to guide the laser beam by transforming the data file coordinates into actual coordinates corresponding to the surface of the structure. The control system then guides the laser beam along the actual coordinates. The coordinates for the pattern in the data file are representations of the position of the pattern relative to reference point locations around the surface of the structure. The reference point locations correspond to the positions at which the sensors are to be placed on the structure. Upon determining a position of the sensors relative to the laser, the control system transforms the data to determine the position of the surface relative to the laser. The control system includes laser-directing optics, a computer for controlling the operation of the laser-directing optics, and a device for receiving output from the sensors and transmitting the output to the computer.

These and other advantages and features will become apparent from the following detailed description of the best mode for carrying out the invention and the accompanying drawings, and the claims, which herein are incorporated by reference.

BRIEF DESCRIPTION OF THE DRAWINGS

In the drawings, like reference figures refer to like parts throughout the several views, wherein.

BEST MODE FOR CARRYING OUT THE INVENTION

While the present invention is particularly well suited for creating stencils for painting designs on exterior surfaces of airplanes, it is believed to have general utility in the application of coatings in general to selected surface portions of many types of objects and structures. Accordingly, for clarity, the following description is directed toward use of the present invention in the painting of designs on exterior surfaces of aircraft. However, it is not intended that the scope of the present invention be limited to aircraft or to painting processes.

The laser-masking method of the present invention essentially eliminates the need for masking tape and paper stencils by using a spray-on liquid maskant that, when applied to the airplane surface, dries to a peelable film. Many commercially-available liquid compounds are suitable for the maskant. U.S. Pat. No. 4,886,704 of Kamada et al, entitled "Strippable Coating Film and Coating Method Using Same", granted Dec. 12, 1989, includes a discussion of various types of strippable coating films, which can be used in the method of the present invention. Generally, the liquid maskant must exhibit good adhesion characteristics to the surface being painted, dry to a peelable film such that it will not tear when being peeled, and readily absorb laser energy so that the maskant can be ablated and sections peeled away, leaving a maskant stencil on the surface. A suitable liquid maskant material is available under the trade name SPRAYLAT SC-1071-B TM, manufactured by the Spraylat Corporation, Mount Vernon, N.Y., U.S.A. This maskant is a water based black pigmented strippable coating material and exhibits good drying time and laser energy absorption characteristics. Solid maskants can be used as well, such as adhesive-backed paper.

The stencil design for the airplane is cut through the maskant material directly applied on the side of the airplane using a computer-guided laser beam. The proposed laser-masking method is summarized as follows.

GENERAL OVERVIEW OF LASER-MASKING METHOD

Figure 1:
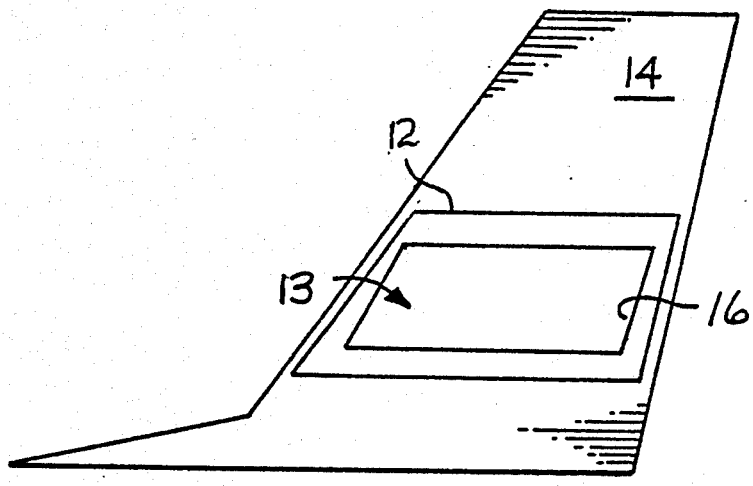
FIG. 1 is an elevation view of the tail section of an airplane with an overspray mask mounted thereon.

As shown in FIG. 1, a paper overspray mask 12 is applied to a target area 13 of an airplane exterior surface where a design is to be painted. An airplane tail section 14 is illustrated in FIG. 1. The overspray mask 12 provides a defined edge 16 for the sprayed on maskant, and protects against overspray onto other parts of the tail section 14 of the airplane.

Figure 2:
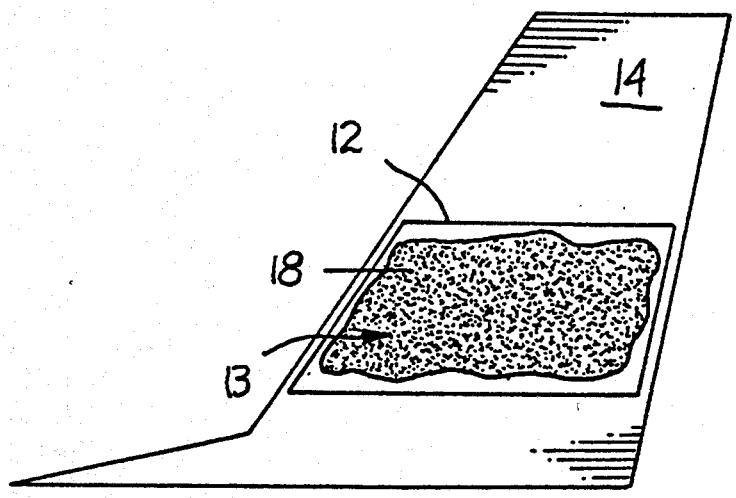
FIG. 2 is a view like FIG. 1, with a layer of liquid maskant applied to a target area of the tail section.

As shown in FIG. 2, a liquid maskant 18 is applied to the airplane exterior surface 14 in an even coat, approximately five mils thick, over the entire area to be painted, extending all the way past the inner edges of the overspray mask 12. The liquid maskant 18 then is allowed to dry.

Figure 3:
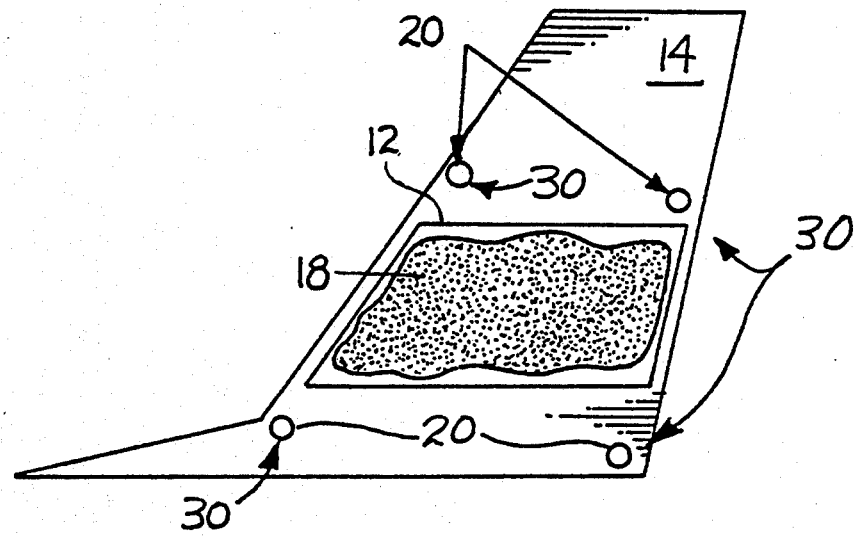
FIG. 3 is a view like FIG. 2, showing position detectors mounted at reference point locations on the tail section.

The position and orientation of the target area 13 to be painted then is determined. In a preferred embodiment, as shown in FIG. 3, this step includes accurately locating and affixing position detectors or sensors 20 to the tail section 14 at predefined reference point locations 30. The reference points 30 should be chosen to correspond with an easily recognizable point on the airplane, such as a certain rivet head or skin lap joint, etc.

Figure 4:
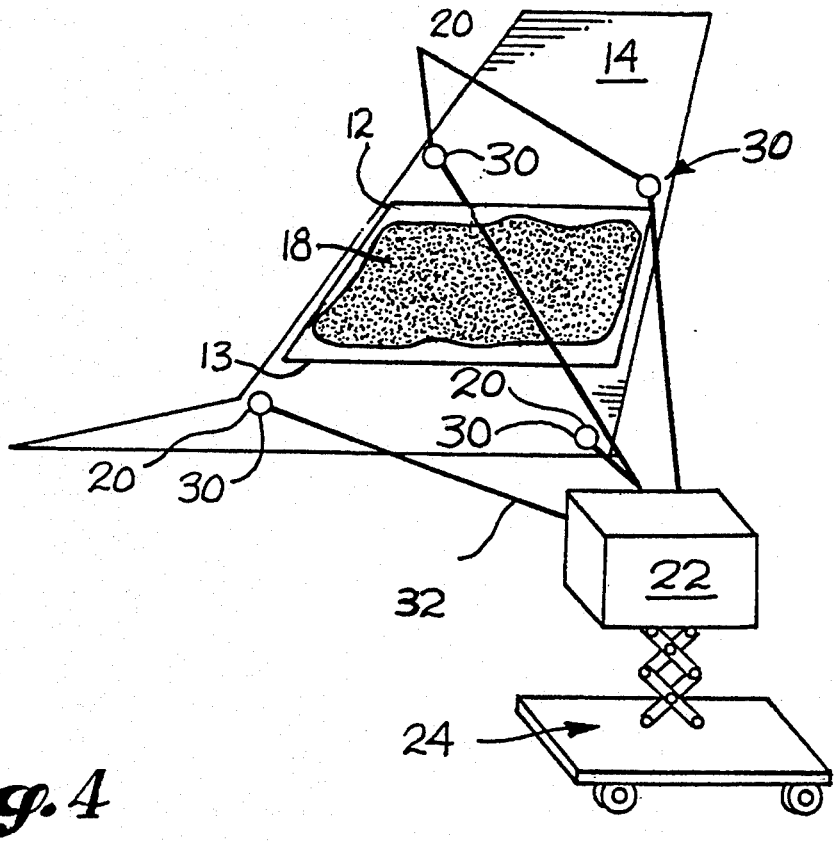
FIG. 4 is a view like FIG. 3, shown with the laser-projector of the present invention positioned so that it confronts the tail section of the airplane and the target area thereof.

A laser, scanner, computer, and controllers are housed in a projector 22, which is mounted on a rollaround cart 24, as shown in FIG. 4. The rollaround cart 24 can be moved and rotated into position confronting the target area 13 of the aircraft, locked down firmly, and raised or lowered as necessary to position its optics in position confronting the target area 13. It is important that the projector 22 be held stationary once the position-sensing and laser-cutting processes are started.

The cart 24 is moved into position approximately ten to seventy feet back from the target area 13, depending on the size of the decorative design. In the preferred embodiment, the scanner has a 40° field of view, so a stencil area with a maximum lateral dimension of twenty feet would require the target area 13 to be at a range of about thirty feet from the scanner. The scanner is the component that redirects the laser beam toward the target area. The scanner is raised or lowered and adjusted in orientation so that the target area 13 is approximately centered and squared within the scanner's field of view. In this process, "eyeball" accuracy is all that is required. The position and orientation in space of the scanner relative to the target area 13 is determined using a position-sensing system, described later. Preferably, the position-sensing system utilizes a low power position-sensing laser beam 32 to determine the position of detectors 20.

For each stencil design and airplane model number, a scan file is created and downloaded to the local control computer. This scan file contains three dimensional (X, Y and Z) coordinates of the points required to form the stencil design, as well as the coordinates of reference points 30 relative to the design. The position of the sensors 20 on the airplane correspond to the reference points 30 in the scan file. Thus, it is important that the position sensors 20 be accurately placed on the airplane at the precise reference point locations 30.

The coordinates of points for the stencil design are referred to as a drawing or "design map." The design map is a representation of the position of the stencil design relative to the reference point locations. Preferably, the design map is designated in three-dimensional coordinates having a predetermined orientation with respect to the reference points 30. It should be noted that each scan file can include more than one design map, should the design include a variety of colors.

A transform function then is performed to convert the design map of the scan file from a file having coordinates relative to the reference points to a transformed file having coordinates relative to the laser and its scanner. The transformed design map contains the position of each point of the stencil design, along the surface of the target area, relative to the laser and its scanner. The transform function can be performed regardless of the initial positions and orientations of the projector and the target area, so long as the target area is within the scanner's field of view and within a certain distance from the scanner. If desired, the stencil layout on the target area can be previewed before laser cutting by projecting the layout onto the target area using a low laser power setting. This allows any necessary corrections to be made to the stencil's design and/or positioning before actual cutting begins.

Figure 5:
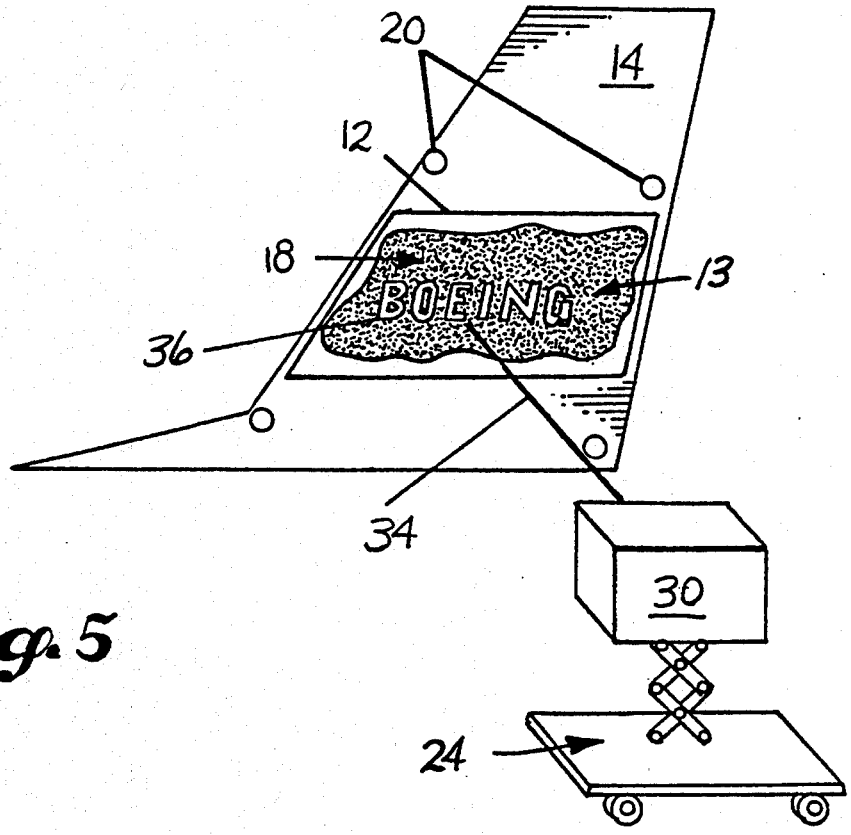
FIG. 5 is a view like FIG. 4, showing a stencil pattern being cut in the maskant.

As shown in FIG. 5, a cutting laser beam 34 is directed along the perimeter of the stencil or logo design 36 into the maskant 18. In practice, the stencil design 36 would not be visible during laser cutting of the maskant 18. However, for clarity, the design 36 is shown in FIG. 5. The laser beam 34 cuts or ablates the maskant film 18 in a fine line without excessively cutting into the paint base coat. The cutting depth of the laser is controlled by controlling the scan speed of the laser. The faster the scan speed for a given laser power and spot size, the more shallow the laser cutting depth. More than one pass over the stencil outline 36 can be performed in order to obtain a more consistent cut through the maskant 18.

The interior (or exterior) areas of the cut maskant, which correspond to the selected portions of target area 13 to be painted, are peeled off, and a top coat of paint is applied to the target area 13. Before the paint dries, the remaining maskant material is peeled away and the design paint is allowed to dry. The process is repeated for subsequent colors, ensuring that sufficient dry time is allowed between applications of the base coat, the liquid maskant, and top coat. The overspray mask can be retained in place if the subsequent color design fits within the dimensions of the overspray mask.

SYSTEM DESCRIPTION

Figure 6:
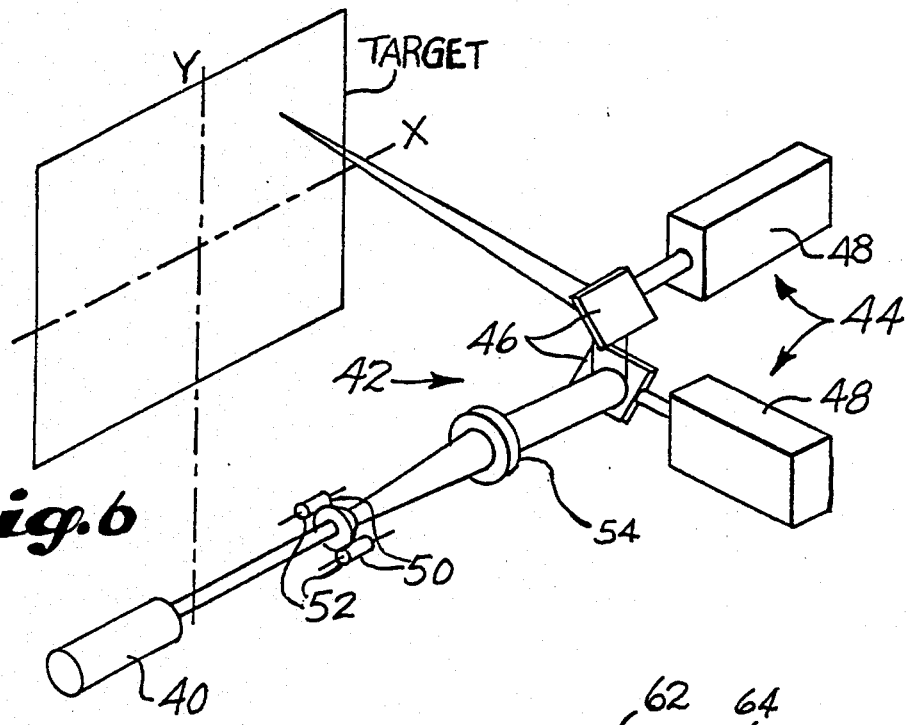
FIG. 6 is a schematic view showing the cutting laser and its associated optics.

FIG. 6 shows a schematic diagram of the cutting laser 40 and its associated optics, indicated generally at 42. The cutting laser 40 can be any moderately powered laser, preferably in the visible to near-infrared spectrum. In the preferred embodiment, an Argon-Ion laser, Model Innova 200-20, available from Coherent, Inc., Palo Alto, Calif., U.S.A., is used with a maximum power output of 30 watts. It is operated in continuous wave, multi-wavelength mode with the main power output at a wavelength of 514 nanometers. This visible (blue-green) wavelength was chosen for three reasons:

1. The energy absorbing ability of the black-colored maskant material was found to be nearly constant across the entire spectrum of available laser wavelengths. Therefore, no one particular wavelength range was found to provide better cutting characteristics than another.

2. Standard $CO_2$ cutting lasers operating in the far infrared region, provide less selectivity between maskant and substrate paint. The longer the wavelength, the deeper the damage to the substrate.

3. Visible wavelengths are much easier and safer to work with over long projection distances since the beam and its reflections can normally be seen by the operator and manipulated or avoided as necessary.

In a production environment, visibility considerations may not be as important, and a YAG laser in the near infrared may be suitable. This type of laser is smaller, simpler and cheaper than an Argon laser of equivalent power output, and the wavelength is short enough that substrate selectivity is provided.

The cutting laser system shown in FIG. 6 utilizes an off-the-shelf dual-axis scanning system 44 with limited-rotation mirrors 46 attached to thermally compensated galvanometer drive motors 48. The dual-axis scanning system 44 is referred to as scanner #2 in subsequent figures. A model XY3037 scanner is used, available from General Scanning, Inc., Watertown, Mass., U.S.A. The optics 42 include either a standard static beam expander 50 or a dynamic focusing lens 52 and an objective lens 54. The dynamic focusing lens 52 changes the focal length in response to a controller, while the laser beam scans 3D contoured targets. This feature is not always needed since the beam's depth of focus oftentimes is long enough to keep the laser spot size on the target within acceptable limits.

To adjust mirrors 46, scanner controllers provide positioning signals to the galvo motors 48, with 16 bit accuracy, giving 65536 points of resolution in both X and Y axes across a 40 angular range. The scanners are repeatable to ±0.01% or 35 μrad at maximum angular deflection. This equates to ±0.7 mm at a range of 70 feet. The maximum speed for scanner mirrors 56 (with a 30 mm pupil to accept the expanded cutting beam) is 300°/sec, which equates to 4400 inches per second.

Figure 7:
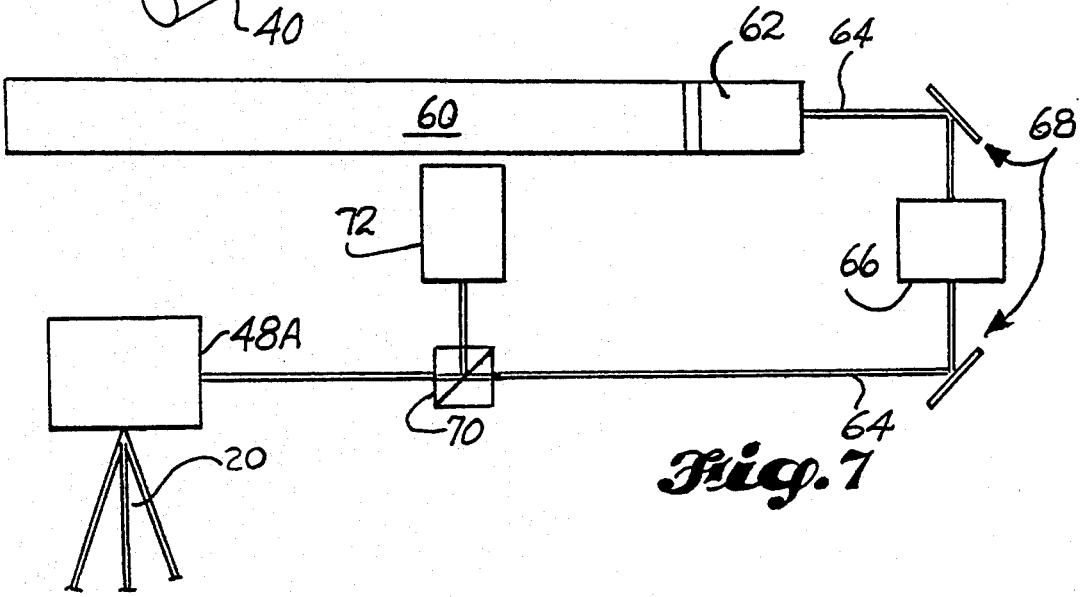
FIG. 7 is a schematic view of the auxiliary laser and its associated optics.

FIG. 7 is a schematic view showing the auxiliary laser 60 and its associated optics. A small low-power (10 Mw) Helium—Neon (He—Ne) laser 60 operating at 632.8 nm is used in conjunction with scanner #1 for position sensing and high speed visualization projections. In the preferred embodiment, a He—Ne laser, Model No. 05LHP991/05LPL370-065, available from Melles Griot, Irvine, Calif., U.S.A., is used and a model XY0507 scanner is used for scanner #1, available from General Scanning, Inc. This auxiliary laser 60 is used for target and personnel safety reasons, and so that the position sensors 20 and the auxiliary laser's optics do not have to handle the relatively high power emitted by the cutting laser even on its lowest setting. The auxiliary laser 60 can also be used for previewing the stencil design on the maskant before cutting. If the chosen cutting laser emits light outside the visible spectrum, the auxiliary laser provides the only visible operator feedback of where the laser spot is falling on the target. It should be noted that, while the preferred embodiment of the present invention utilizes two lasers, a high-powered cutting laser and a low-power auxiliary laser, a single laser with multiple power levels could be used, or even one laser with one power level could be used so long as the optics and sensors are compatible therewith.

The dual-axis scanner #1 is similar to scanner #2 of the cutting laser system. The mirrors of scanner #1 are smaller than the mirrors of scanner #2 due to the lower intensity laser beam of auxiliary laser 60, as well as the less stringent focusing requirements for the auxiliary laser and the need for high speed scanning for visualization. Instead of dynamic focus, the auxiliary laser 60 utilizes an optic telescope 62 in the auxiliary laser beam path 64. Instead of automatic dynamic focusing, the telescope 62 provides for manual focusing to compensate for any large variations in distance from one target to the next. The telescope 62 first expands the beam by some fixed ratio before focusing. This allows for longer focal lengths and/or a more tightly focused spot. Also, the maximum speed for scanner #1 (with a 5 mm pupil) is 3000°/sec which equates to 44,000 inches per second at a range of 70 feet.

The auxiliary laser optic system of FIG. 7 is equipped with an acousto-optic modulator (AOM) 66 whose function is to blank the auxiliary laser beam 64 when the beam 64 moves from the end of one scan vector to the start of the next. In the preferred embodiment, a model N23080-3/N21080-2DS Accousto-Optic Modulator, available from NEOS Technologies, Melbourne, Fla., U.S.A., is used. The AOM may also be used to provide continuous high frequency modulation to reduce the beam power to a given level, in order to meet, for example, class II safety requirements, by controlling the duty cycle of the output pulses.

When the crystal inside the AOM 66 has RF power applied to it from its driver, it refracts a large percentage of the laser beam intensity by a small angle from its original path. The optics are aligned in such a way that only this refracted portion reaches scanner #1, and the rest is directed into a beam stop. Thus, the laser beam appears to be "ON" only when the AOM 66 is energized. This feature also provides an added safety feature in that the projector is failsafe—if power is lost to the projector, and the beam is left stationary, the AOM 66 will also be de-energized, and will turn "OFF" the laser, even if it still has power.

Modulation is not required for the cutting laser, and blanking of the cutting laser between vectors is not needed, because cutting can be more easily controlled by merely speeding up the scanner #2 slew rate. Also, the power level of most higher power lasers is more easily adjustable via the laser's own controls than with modulation duty cycle manipulation.

The (AOM) 66 is positioned between a pair of turning mirrors 68. Mirrors 68 reflect the auxiliary laser beam 180° toward a beam splitter 70. Beam splitter 70 directs a portion of the auxiliary beam 64 toward a photodiode detector 72, and a portion toward scanner #1.

The position detectors 20 are adapted to receive, as input, an incident laser beam from scanner #1, and based on this input, produce an output signal, which provides an indication to the computer of the position of detectors 20. In this sense, detectors 20 may be sensors, detectors, reflectors, or any other similar device capable of providing a position-indicating output signal for ultimate use by the computer.

For position detectors 20, the laser-masking system of the present invention uses an adhesive-backed retro-reflective sheet material, made by 3MPackaging Systems Division, St. Paul, Minn., U.S.A., product number 2000X, for the position detectors 20. This retro-reflective material is cut into any desired shape (circle, square, donut, etc.) and placed over the reference points on the aircraft surface. The material is designed in such a way that a laser beam impinging on it from any angle up to 60° will be reflected back upon itself toward the source (with some significant loss in intensity and beam coherence). When the laser beam is impinging on one of these sensors, the reflected light can be detected by the photodiode detector 72 in the projector head.

Reflected light returning from a position detector 20 is redirected by the scanner mirrors of scanner #1, and is directed into the photodiode detector 72 by the beam splitter 70. Before reaching the detector's active surface, the reflected light goes through a focusing lens, and a 633 nm bandpass filter (to reject noise from ambient light). A Model No. 13DS1011 for the photodiode, Model No. 13DMA001 for the lens, and Model No. 03FIL024 for the filter, available from Melles Griot, Irvine, Calif., U.S.A., are used for the photodiode detector 72. The photodiode detector 72 produces an output current that is proportional to the intensity of light that impinges on its active surface. The detector is very sensitive to low light levels, and the attached amplifier has a large dynamic range in order to capture the range of possible signal levels.

Figure 8:
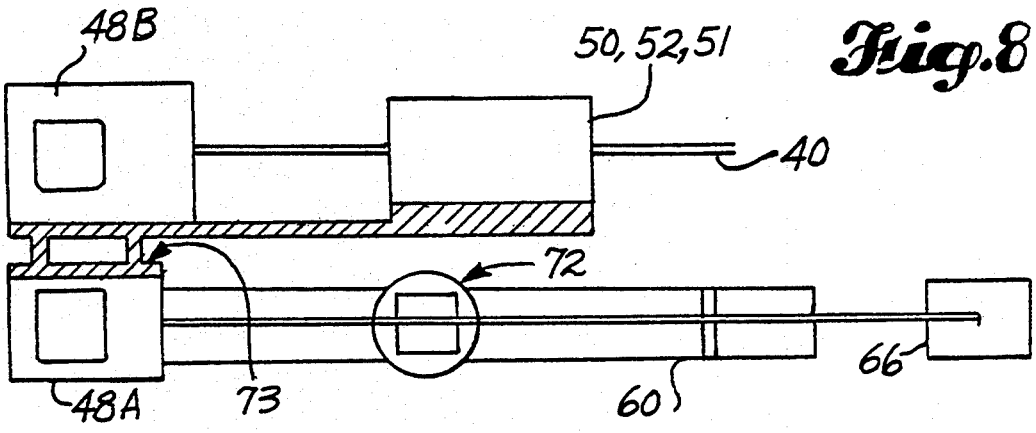
FIG. 8 is a schematic elevation view of the cutting and auxiliary lasers and their associated optics.

FIG. 8 is a side view of the system. The cutting laser 40 and its associated optics 44, 50, 52, 54 are mounted above the auxiliary laser 60 and its associated optics, scanner #1 and elements 66, 72. Scanner #2 is fixed securely a predetermined distance above scanner #1.

Figure 9:
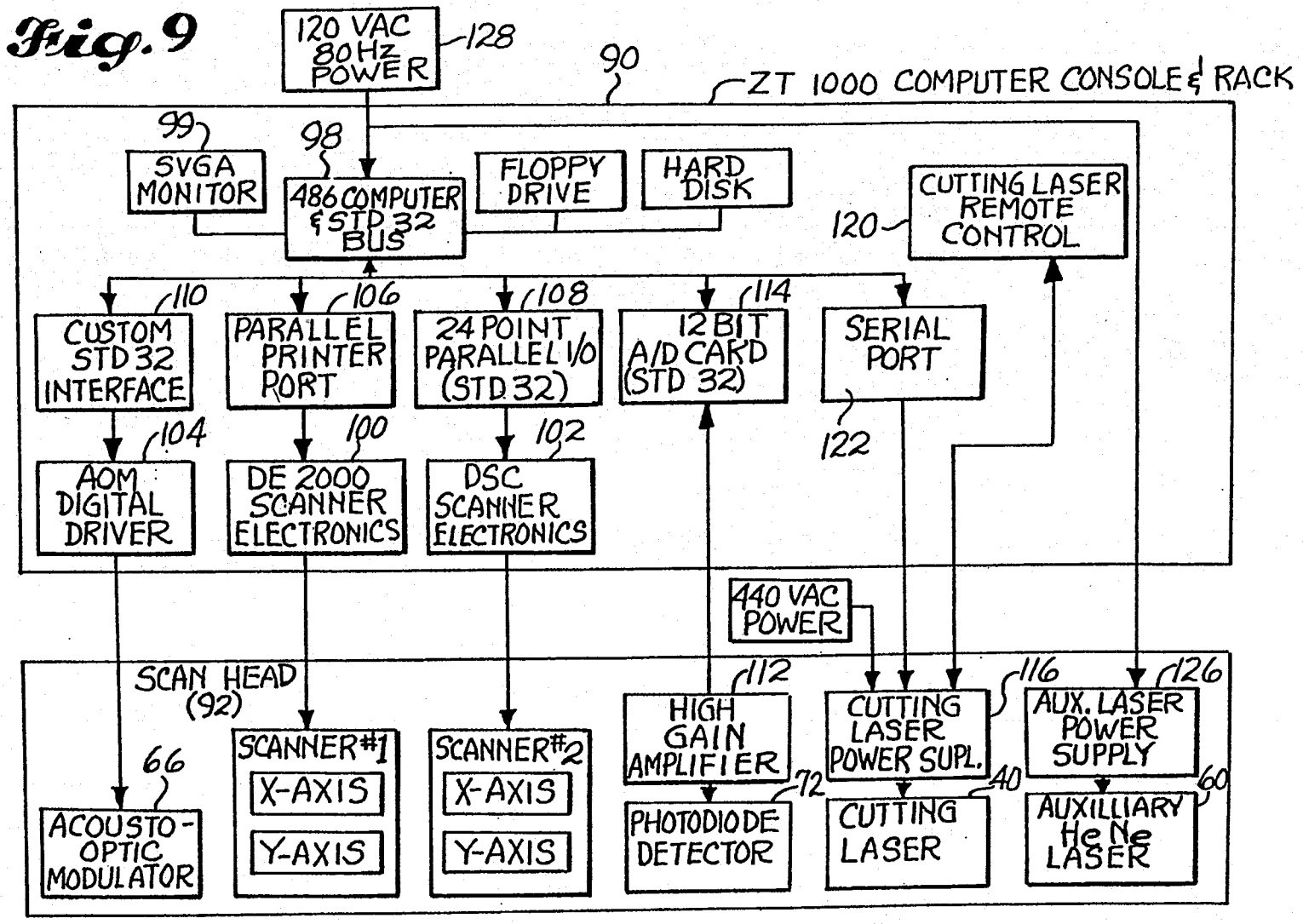
FIG. 9 is a block diagram of the laser-masking system of the present invention, without the position sensors shown.

FIG. 9 is a block diagram of the laser-masking system. The system includes a work station 90 and a scan head 92. The work station 90 and scan head 92 are mounted in the projector 22 atop the mobile cart 24. A Model ZT-1000 work station, available from Ziatech, Inc., San Luis Obispo, Calif., U.S.A., is used for work station 90.

An STD-32 bus architecture is used in the computer control system in order to allow modular addition of various control components. The work station 90 uses an 80486-50 Mhz PC-compatible computer 98 with 8 MB of RAM on a single STD-32 board. A monitor 99 is provided for user interface. The computer 98 performs the mathematical transformations required for position sensing and projection of the stencil design onto 3D contours. It also processes the photodiode detector inputs, and controls the scanner drivers, and the acousto-optic modulator driver.

Scanner drivers 100, 102 provide the interface between the computer 98 and the galvanometer motors in scanners #1, #2. Scanner driver 100 is a Model No. DE2000 scanner driver, available from General Scanning, Inc. It receives scanner positioning data in ASCII format from the computer's printer port 106, and converts it to analog step commands required by the scanner galvos. An onboard microprocessor handles control of the slew rate between vector endpoints, as well as modulation signals to the acousto-optic modulator 66 for beam blanking between vectors. The DE2000 was chosen to drive the higher speed auxiliary scanner #1 because of these extra microprocessor capabilities.

Scanner driver 102 is a Model No. DSC, available from General Scanning, Inc., and performs the same interface functions for scanner #2 as scanner driver 100 performs for scanner #1. The difference is that scanner driver 102 has no onboard microprocessor to handle slew rate control (which is less critical for the lower speed scanner #2) or beam modulation (which is not needed for the cutting laser). The slew rate control for driver 102 is continuously provided by the computer 98. Driver 102 receives data from the computer's parallel input/output port 108.

As discussed previously, the acousto-optic modulator (AOM) 66 is placed in the beam path of the auxiliary laser 60 to provide ON/OFF modulation of the beam. An AOM RF driver 104 provides RF power as directed by its input for operation of the AOM 66. Driver 104 has inputs from two different places in parallel, scanner driver 100, and a custom-built driver circuit 110. Diodes are placed on the output of these circuits to prevent interference. Also, since the inputs are in parallel, only one circuit may attempt to turn on the laser at one time, or the results may be unpredictable. This is controlled by software.

During high speed projection using scanner #1, the AOM driver 104 receives signals from scanner driver 100 in order to blank the beam whenever specified by the scan file between scanned entities. During times when the auxiliary laser beam is stationary or moving relatively slowly, safety rules dictate that the laser beam power be reduced below class II levels. To accomplish this, a simple custom circuit is provided on an STD-32 card 110 to which the software can send a signal to set the laser power at one of four different levels. These levels are OFF, ON-LOW, ON-MEDIUM, and ON. For OFF, the output to the AOM RF driver 104 is a TTL low and the AOM stays off. For ON, the output is a TTL high and the AOM is continuously on. For the two intermediate levels, the card 110 outputs a 20 Khz square wave to turn the AOM ON and OFF at this rate. The duty cycle of the square wave is set to 10% or 40% to give the LOW and MEDIUM power levels respectively.

The photodiode detector 72 receives reflected light from the position sensors on the target surface during a calibration sequence. The photodiode detector 72 has a low level analog current output that is proportional to the level of the reflected light that is received. A high-gain amplifier 112 on this output circuit raises the level of the photodiode signal, and converts it to an analog voltage in the 0–2 volt range. An analog-to-digital converter 114 on the STD-32 bus then provides this signal in digital format to the computer for use in the position-sensing routines.

The cutting laser 40 receives its own separate source 116 of 440 volt AC power. The cutting laser system is provided with a handheld remote control 120 for turning the laser ON and OFF, and adjusting the power level, among other functions. The system is also provided with a serial communication port 122 that can be used in place of the handheld remote if desired. Via the serial port 122, the computer 98 can control the cutting laser's ON/OFF timing, and adjustments to the power level. The details of this control interface are highly dependent on the particular cutting laser system chosen. The auxiliary laser 60 is provided an auxiliary laser power supply 126, fed from the main power supply 128 for work station 90.

As described in the Program Software Outline section, the position-sensing software provides the user interface for controlling the scanners to manually move the auxiliary laser beam onto the position sensors, and to automatically center the beam on the sensors. The position-sensing software also contains the math routines for scan file coordinate transformation, given a completed position sensor calibration.

CALIBRATION AND TRANSFORMATION

The position-sensing system calibrates the position and orientation of the workpiece (airplane) relative to the cutting laser and uses this information to transform the design map into the scanner coordinate system. Since the cutting laser and auxiliary laser (and their scanners) are mounted a fixed distance apart, the preferred method is to determine the position of the target area surface relative to the auxiliary laser scanner #1, then correct for the known distance between the scanners. The system operates at long range (up to about 100 feet), and its accuracy can be fine tuned by adjusting various operating parameters. For aircraft logo painting, positions must be accurate, generally, to 0.1 inch for small logos, up to 0.25 inch for large logos in lateral dimensions, and approximately 1.0 inch in the range dimension.

Currently available methods of position sensing include laser radar, photogrammetry, and jigs for predefined relative positioning of the laser and the workpiece, among others. For laser masking, as well as numerous other positioning applications, these methods are satisfactory and can be used in lieu of the position-sensing systems of the preferred embodiment. However, these alternative methods are complex in operation, require greater equipment expense and/or involve long process times. The fundamental problem in any position-sensing system is in determining the range to a given point on the target.

With laser radar, this problem is solved by using a range-finding laser, but this equipment can be very expensive, and is more accurate than required for laser masking. Tooling jigs determine range by making it non-variable, but this again can be expensive, requires bulky, complicated tools, and removes the desirable element of positioning flexibility. In photogrammetry, extremely accurate cameras take pictures of the target from various angles at known positions, thus essentially triangulating the range and position of any given point. The cameras used in photogrammetry are usually expensive and complicated to use, and the data they provide can be difficult to put into a form that can be utilized by a computer in a simple way.

MATHEMATIC DESCRIPTION

The preferred position-sensing method involves performing a resectioning 3D transformation to generate a set of scanner positions. The set of scanner positions produces the desired pattern on the workpiece, given those same positions in a 3D drawing or design map. Scanner positions are given in galvanometer (galvo) counts for each of the two mirrors in the scanner. The scanner can be either the auxiliary laser scanner #1 or the cutting laser scanner #2, depending on which laser is being projected.

The range of galvo counts is 0–65535 in both the X and Y directions. The scanner coordinate system has its origin at the point on the second scanner mirror where the beam makes its final deflection toward the workpiece, when the scanner mirrors are both centered within their ranges of motions (32768×32768 galvo counts). The laser reflection point on the second mirror is displaced from this origin across the second mirror by a small amount whenever either mirror is rotated away from its centered position. The points in the coordinate system of the original 3D design map must be transformed into the coordinate system of the physical workpiece onto which the pattern will be projected with the scanner at the origin. The transformed points are then converted from 3D vectors into galvo counts.

After the auxiliary laser is centered on a position sensor, its scanner position in galvo counts must be found for this sensor. The coordinates of the reference point locations (calibration points) must be known in the same 3D design map coordinate system as the rest of the pattern points for the design. By manually steering the laser spot with the scanner onto each of the position sensors, the following sequence of steps is performed:

1. The galvo counts corresponding to each position sensor (calibration point) are used to compute the coordinates of the laser beam reflection point (P) and laser beam direction vector (B) in the scanner coordinate system.
2. The set of reflection points (P) and direction vectors (B) is used along with the coordinates of the same calibration points in the 3D design map coordinate system to find the transformation relationship between the two coordinate systems.
3. The coordinates of the pattern points are then transformed from the 3D design map coordinate system into the 3D scanner coordinate system.
4. Finally, galvo counts (2D) are found which correspond to each pattern point.

Figure 10:
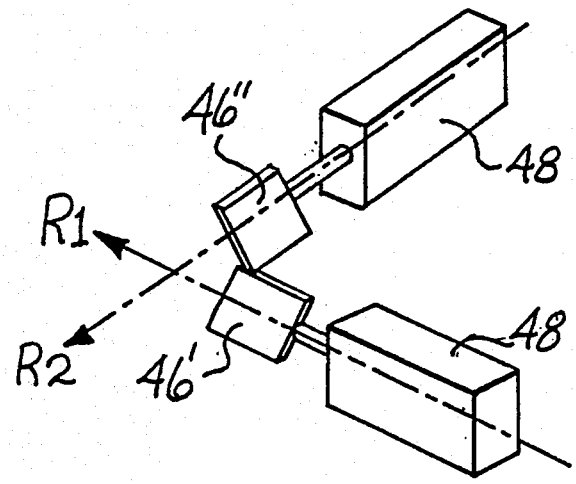
FIG. 10 is a pictorial view of the auxiliary scanner.
Figure 11:
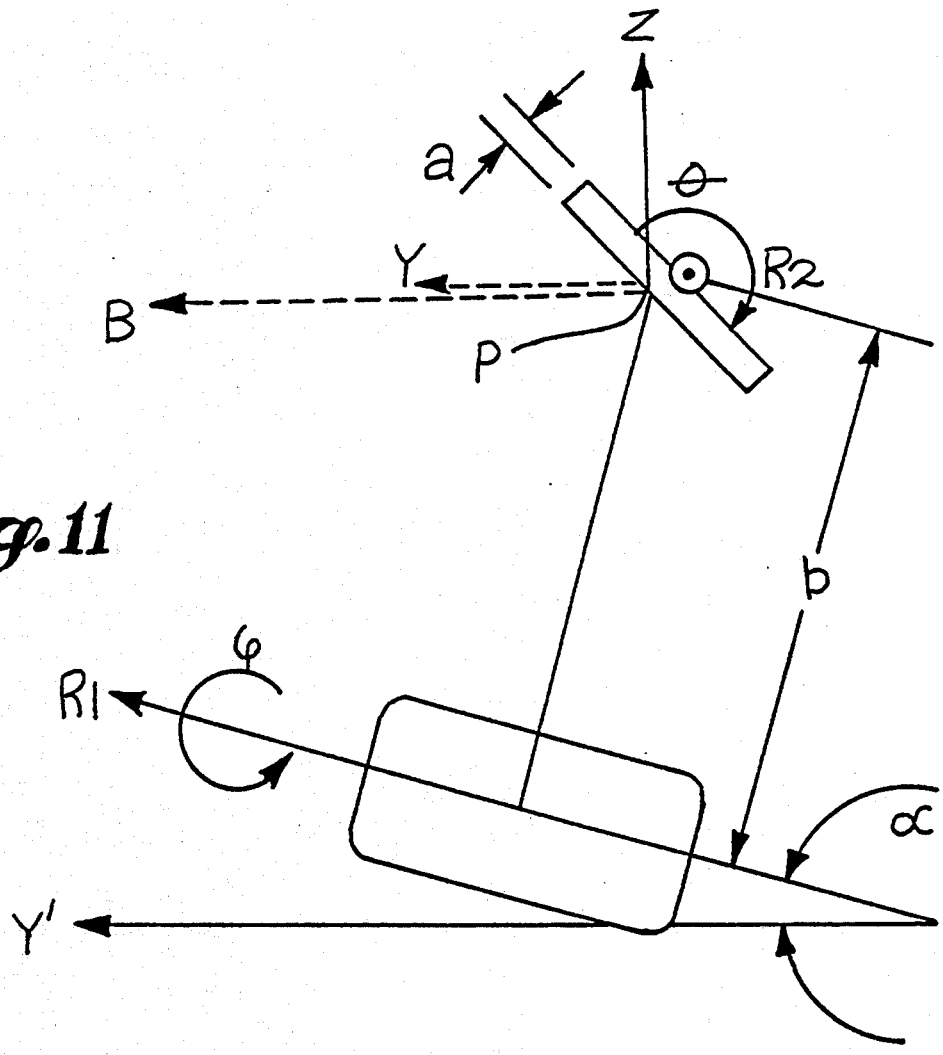
FIG. 11 is a schematic view of the scanning mirrors of the auxiliary scanner, showing the geometry associated with the preferred position-sensing method.

Step 1 is accomplished using basic geometry. FIG. 10 shows an oblique view of the two-axis scanner for the auxiliary laser. $R_1$ is the rotation axis vector of the first galvo mirror 46'. $R_2$ is the rotation axis vector of the second galvo mirror 46''. FIG. 11 shows a schematic side view of the scanner with critical dimensions and angles labelled as follows:

x,y,z: Scanner coordinate system. The y axis points horizontally toward the workpiece, coincident with the laser beam with both scanner mirrors centered within their ranges of motion (32768,32768). The z-axis points vertically up from the same origin, and the x-axis points to the right when facing out from the scanner to form a right-handed coordinate system.

$\phi$ = Angular rotation in degrees of the first mirror about its rotation axis ($R_1$).
= 20° *(galvo1 counts − 32768)/32768.

$\theta$ = Angular rotation in degrees of the second mirror about its rotation axis ($R_2$).
= 20° *(galvo2 counts − 32768)/32768.

a=Offset between the surface of each mirror and its own rotation axis.

b=Separation between the two rotation axes.

$\alpha$=Angle between the rotation axis of the first galvo and the horizontal plane.

P=Beam reflection point: the location on the second mirror where the laser beam reflects toward the workpiece.

B=Beam direction vector: the unit vector which describes the direction of the laser beam as it leaves the scanner.

(Together, the reflection point and the direction vector are called a ray.)

The beam reflection point (P) and direction vector (B) are functions of $\Psi$ and $\theta$:

$$P = \begin{bmatrix} \left[\frac{a}{\sin\gamma} - b\right]\tan\phi - \frac{a}{\cos\sigma} + \frac{a}{\cos\sigma_0} \\ \frac{\left[\frac{a}{\sin\gamma} - a\right]}{\sin\gamma_0}\sin\alpha \\ -\frac{\left[\frac{a}{\sin\gamma} - a\right]}{\sin\gamma_0}\cos\alpha \end{bmatrix}$$

$$B = \begin{bmatrix} -\sin\phi \\ \cos\phi * \cos\theta \\ \cos\phi * \sin\theta \end{bmatrix}$$

where, $$\sigma = 45° - \phi/2 \qquad \sigma_0 = 45°$$

$$\gamma = 45° + \frac{\alpha}{2} - \frac{\theta}{2} \qquad \gamma_0 = 45° + \frac{\alpha}{2}$$

The computer takes as inputs the galvo counts to the position sensors, and the 3D design map coordinates of the reference point locations, and gives as output the point P and vector B.

Steps 2 and 3 are accomplished together in three parts:

a) The locations of the calibration points are estimated in the scanner coordinate system by intersecting each beam ray with a plane representing the workpiece (which may or may not actually be three-dimensionally contoured).

b) These estimated points are used to compute an approximate relationship between the two coordinate systems and this approximation is used to transform both the calibration points and the pattern points approximately into the scanner coordinate system.

c) A more exact relationship between the two coordinate systems is computed using an iterative resectioning algorithm, and all the points are transformed into the scanner coordinate system.

Part (a) requires the operator to supply an approximate range and tilt (relative to the scanner coordinate system) of the plane formed by the calibration points. If 4 or more calibration points are used (as preferred) and no single plane is formed, the easiest method is to specify a vertical plane perpendicular to the scanner's line-of-sight (y axis) by passing zero values for tilt to the algorithm. If 3 calibration points are used, the tilt about the scanner's x and z axes should be accurate to about 2 degrees. The range should be the approximate distance from the scanner to the workpiece along the scanner's line-of-sight (y axis), and may be relatively inaccurate. Preferably, the range automatically is selected by the computer with no user input.

Part (b) computes the nine-element rotation matrix and translation vector which, when applied to the set of coordinates for the calibration points specified in the 3D design map coordinate system, best fit the set of estimated coordinates for those same points specified in the scanner coordinate system. This is done using an algorithm known as QDAlign, which makes use of the mathematical procedure called singular value decomposition (SVD), which can be found in most advanced mathematics texts. See for example, "Determining a Simple Structure When Loadings for Certain Tests are Known," by C. I. Mosier, *Psychometrika,* 1939, Vol. 4, pp. 149–162. The transformation is then applied to both the set of calibration points and the set of pattern points to transform them approximately into the scanner coordinate system.

Part (c) solves a system of non-linear equations to compute a more exact transformation. If 4 or more calibration points are used, a least-squares best fit solution is found. For each calibration point Q, beam reflection point P, and beam direction vector B (computed in Step 1 above), the following vector equation arises:

$$E=(M\,Q+N-P)\times B$$

where M is the nine element rotation matrix expressed as a function of three angles: yaw, pitch, and roll, taken about the y, x, and z axes, respectively. N is the three element translation vector. The solution is the set of six parameters (yaw, pitch, roll, $N_x$, $N_y$, and $N_z$) that minimize the sum of the squares of the components of each E vector:

$$e=\Sigma(E_x^2+E_y^2+E_z^2).$$

Taking partial derivatives of e with respect to each of the six unknown parameters and setting these derivatives equal to zero gives rise to a non-linear system of six equations in six unknowns. This system can be iteratively solved using a variation of the Newton-Raphson method, which is discussed in a mathematics text titled, *Numerical Analysis,* by Melvin J. Maron, copyright 1982, pp. 176–181. The procedure is summarized as follows:

a) Start with all six parameters set to zero.

b) Compute E for each of the calibration points.

c) Compute the partial derivatives of each E with respect to each of the six parameters.

d) Build up the 1×6 Gradient vector G where the (i'th) component of G is the dot product of the partial derivative of E with respect to the (i'th) parameter and E itself, summed over all of the E's.

e) Build up the 6×6 Hessian matrix H where the (i'th, j'th) component of H is the dot product of the partial derivative of E with respect to the (i'th) parameter and the partial derivative of E with respect to the (j'th) parameter, summed over all of the E's.

f) Solve the linear system H U=G for the unknown 6×1 vector U.

g) Compute new values for each of the six parameters by subtracting the corresponding component of U.

h) Repeat Steps b–g until the sum of the components of the vector U is less than some convergence limit.

This final set of six parameters (rotation and translation) defines a transformation, which then is applied to both the set of calibration points and the set of pattern points to transform them as exactly as possible into the scanner coordinate system. Functions within the position-sensing software accomplish tasks (a), (b), and (c) in sequence. These functions take as inputs the output from the previous function, and give as output the 3D vector coordinates of the calibration points and pattern points in the scanner coordinate system.

Step 4 is accomplished by reversing the procedure in Step 1. For each pattern point, a pair of galvo counts (Q) must be found such that $$Q=P+r\,B$$

where P and B are the beam reflection point and direction vector and r is the distance from P to Q. (Note, however, that galvo counts must be integers and, thus, this equation can rarely be exactly satisfied due to roundoff error). Due to the complexity of the equations for P and B specified in Step 1, a closed form solution to this problem cannot be found. Therefore, an iterative solution is applied which proceeds as follows:

i) Start with both galvo counts (Q) equal to 32678 and rotation angles $\Psi=\theta=0$.

j) Compute P and B from the current values of $\Psi$ and $\theta$.

k) Compute new values of $\Psi$ and $\theta$ as:

$$\phi = \arctan\left[\frac{-(Q_x - P_x)^2}{\sqrt{(Q_y - P_y)^2 + (Q_z - P_z)^2}}\right]$$

-continued $$\theta = \arctan\left[\frac{Q_z - P_z}{Q_y - B_y}\right]$$

l) Compute a new pair of galvo counts (Q), rounding to the nearest integer.

m) Repeat Steps b–d until a consistent pair of galvo counts (Q) is found.

A function within the position-sensing software takes as input the output from Step (c), and outputs the final set of scanner counts in the scanner coordinate system that places the scanned points on the desired locations on the workpiece.

SCAN FILE DATA FORMAT

Figures 12, 13:
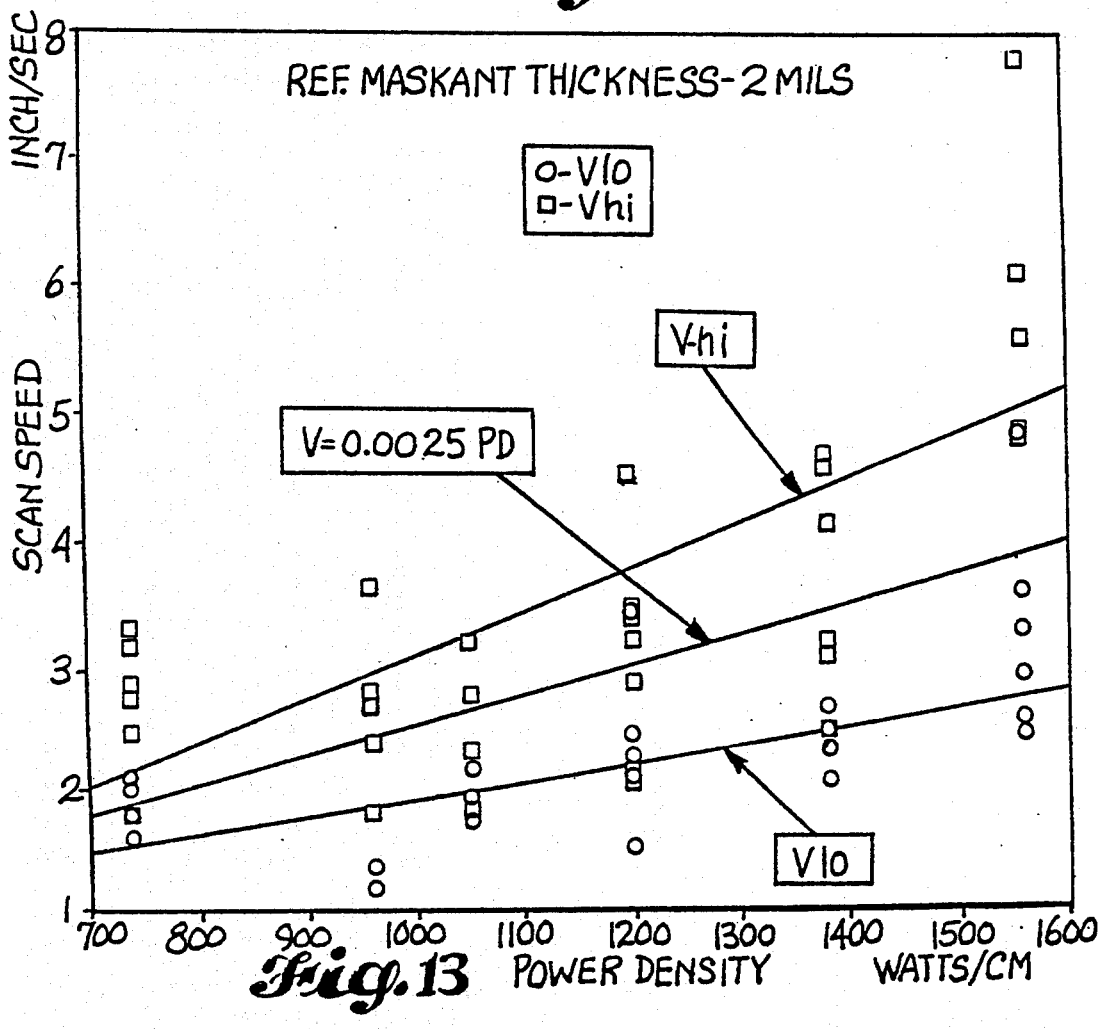
FIG. 12 is an example of a portion of a scan file for drawing simple objects.
FIG. 13 is a reference chart showing the range of acceptable scan speed spreads versus power density.

The listing of FIG. 12 illustrates the format for a typical scan file to draw three shapes, containing six reference points (sensor locations), and 347 scan points forming the three shapes. Scan files can be created off-line from 3D CAD data, and saved in standard ASCII format. Coordinate values must be in airplane coordinates, which essentially means any orthogonal 3D system with consistent units throughout. As in the example below, this will usually be the standard airplane drawing coordinate system in units of inches.

In the current implementation, the first line in the file is a check string used as an initial check on the validity of the scan file.

The second line gives the total number of references points in the file, followed by the XYZ coordinates of the points in airplane coordinates. All coordinate points should be given in the format shown with X, Y, Z values. The third line gives the total number of scan endpoints in the file, and the fourth line gives the total number of entities in the file, followed finally by that number of entity listings. The first line of each entity listing gives a descriptive name for the entity as a label, followed by the number of points in that entity. Lines below the label give the airplane coordinates of the scan endpoints for the entity.

The numbers of points in each of the entities must total to the number given at the start of the file for the total number of scan endpoints. Likewise, the number of entity listings must match the associated number in the header, and the actual number of points listed for each entity must match the number listed with its label. An entity is defined as a sequence of scan endpoints that are to be drawn continuously by the scanner. The end of an entity correlates to a pen-up command on a pen plotter when the pen (laser beam) needs to be lifted from the paper (turned off) in order to move to the start of a new continuous set of points.

Before any laser projections or cutting can be done, data sets (referred to as "scan files") containing the desired geometry must be created. If the workpiece, onto which the design will be projected is flat or nearly so, the data set may be created in only two dimensions. For many applications, the workpieces will have a three-dimensional contour, and the scan files therefore are created in three dimensions. If the target actually is flat, a 3D representation can still be used.

In order to create the artwork for the scan file, the surface of the workpiece (airplane) must be available in a 3D CAD computer model (e.g. CATIA or AUTOCAD). The artwork for the design to be projected (along with the reference point locations) is normally available in a two-dimensional representation in the same CAD system. It is then a fairly straightforward process in software to map the 2D artwork onto the desired location on the 3D contoured surface of the workpiece within the graphical environment of the CAD system to create a 3D design map. This process transforms the artwork from a 2D to a 3D representation with the same contour as the workpiece. Alternatively, the artwork may be created from the outset by any method desired in its final 3D contoured form, bypassing the need for creation of software mapping algorithms. The design map is a 3D (or 2D) representation of the coordinates of a contoured stencil pattern, the contour of which matches the contour of the airplane. The design map has reference to the reference point locations, also created as part of the scan file.

Once the artwork is in 3D form, it is necessary to point sample the individual lines into incremental steps. The laser scanners, being digitally driven, can only project straight lines. Thus, any curves in the artwork (including straight lines mapped onto a contoured surface) must be digitized into steps small enough to eliminate the appearance of jaggedness. Again, this process may be accomplished with software, or by any other desired means, including manual.

The final output of the above two processes (contour mapping and point sampling) is a list of XYZ coordinate points defining the path or the design map for the scanner to follow in projecting the artwork design. In order to put the scan file into a format as specified in the previous section, an automated computer algorithm (or other suitable means) distinguishes between reference points and projectable geometry data points, and makes a count of the total numbers of each. It also distinguishes the points at which one projected entity ends and another begins, counts up the total number of entities, and breaks up the scan file listing appropriately.

POSITION-SENSING PROCESS

The first step in the position-sensing process is to position accurately the positions sensors at the predetermined reference point locations on the airplane surface, affixing them using the adhesive backing. The position sensors should be cut from reflective sheet material into a shape that facilitates accurate positioning. Circles and squares work well, and should be kept relatively small for the sake of visual resolution, and to minimize the time for automatic centering of the laser beam. A small hole may be cut in the center of the sensor to aid in locating the reference sensor at the reference points about the target area. The reference points should be chosen to correspond with an easily recognizable point on the airplane, such as a certain rivet head or skin lap joint, etc.

The laser projector is moved into the desired position and orientation so that the target area of the workpiece is within the scanner's field of view. The control computer then performs the position sensing, scan file transformation, and scanning routines of the transformed scan file to cut the stencil.

In particular, an operator makes any desired changes to operating parameters under the General Setup and Projector Setup menus as prompted by the computer program. Then, the operator uses the Calibrate menu to find the relative positions of each of the detectors. The scan file (if one has been loaded) then will automatically undergo coordinate transformation to transform the detector reference coordinates to scanner coordinates.

The scanner (or laser) coordinates comprise a second coordinate reference frame into which the scan file must be transformed. The second reference frame corresponds to the laser and its scanner, and is used to represent the position and orientation of the design map relative to the laser. With the target range calculated, the operator selects Projector Setup again and/or Cutter Setup options if desired to change the projection speed or the cutting speed, respectively.

Once the calibrate routine has been completed, the operator selects a previously stored scan file (if one has not already been loaded). With the calibration and the scan file available, the computer automatically calculates the coordinate transformation and applies it to the scan file, making the scan file ready for scanning onto the target area.

The computer actually performs two transformations for the scan file. One transformation transforms the scan file directly into the coordinates of scanner #1, from which scanner the sensor positions on the target were found. A second transformation is calculated for scanner #2, to compensate for the relative position and orientation between the two scanners. The first transformation is used by the computer for projections from scanner #1, and the second transformation is used for cutting via scanner #2.

COATING APPLICATION

The base coat of paint on the aircraft must be allowed to cure sufficiently so that the maskant applied over it does not damage the paint. A complete cure, however, is not required. The minimum base coat cure time required varies due to several variables, but is on the order of 4 hours for a typical airplane.

Once the base coat is dry, the maskant is sprayed on over it to a thickness of about 5 mils using a standard air-atomizing paint gun. If using Spraylat for the maskant, the Spraylat may be thinned with water if desired in order to allow it to pass more easily through the spray gun. The maskant must be allowed to cure completely before it can be cut by the laser. For Spraylat, this requires approximately 2 to 3 hours.

Using current masking tape and paper template masking techniques for aircraft, there is a minimum base coat cure time required before masking materials may be applied. This is a called "dry-to-tape" time and is generally on the order of 7 hours. The equivalent time period for laser-masking system of the present invention includes both the base coat dry time and the maskant dry time. The "dry-to-tape" time for the sprayed on liquid maskant has been found to be equivalent or slightly less than that for standard masking tape methods—about 6 to 7 hours.

Once the maskant has been cured, and the stencil outline cut and peeled away, the top coat is applied. The top coat should only be allowed to dry for up to about 30 minutes before the maskant is removed. The maskant must be removed before the top coat hardens, otherwise it will be difficult to lift, and will leave a ragged edge in the paint.

CUTTING THE MASKANT

The maskant material (SPRAYLAT) preferably is colored black so that it more readily absorbs energy from the laser. The absorptivity is increased from 55% for non-colored SPRAYLAT to 90% with black colorant. It is desirable for as much of the energy as possible to be absorbed in the maskant so that very little is absorbed by the paint base coat. In other words, it is desirable to cut the maskant cleanly without excessive damage to the paint underneath. A small amount of damage to the base coat is tolerable as long as it leaves at least 1.5 mils or so of paint out of an approximate 3 mil total paint thickness. After the stencil is painted, the damage will be filled in by the topcoat along a sharply defined paint edge, so any remaining indentation is not very noticeable, if at all.

The power density (Watts/cm$^2$) of the cutting beam is held constant, and the scan speed of the laser varied in order to produce the desired cutting characteristics. However, alternatively, the power density could be varied and the scan speed held constant. The parameters of interest are the laser power (P), the cutting laser beam spot diameter (d), the thickness of the maskant (h), and the scan speed (v). The power density, represented by the following equation:

$$PD=4\,P/\pi d^2$$

is constant for a given laser power and spot size. Laser power is held constant by the cutting laser power supply. The spot size is nearly constant unless the target area is highly contoured, since the depth of focus is relatively long for the long focal length used. For shorter focal lengths or highly contoured targets, there may be a need to vary the focus for constant power density. This can be accomplished by computer control of the dynamic focusing lens of the cutting laser optics.

With a constant power density, the only other variables in the cutting process are the maskant thickness (h) and the scan speed (v). With careful application of the maskant, thickness (h) variability can be minimized. This leaves scan speed (v) as the controlling variable for cutting quality.

Through experimental and statistical analysis of the laser cutting process, the relationship between power density and allowable scan speed range has been established. The chart of FIG. 13 illustrates this relationship. The major variables used in the analysis included the power density, scan speed, substrate paint reflectivity (color), and maskant thickness. A total of about 1800 laser cuts were performed for a good statistical sample.

The effect of the substrate paint color was determined to be comparatively negligible. The effect of variation in the maskant thickness was found to approximate the following relationship:

$$V_0\,(h_0+\partial)=V_1\,(h_1+\partial)$$

where $V_1$ and $h_1$ are the measured scan speed and maskant thickness, $V_0$ and $h_0$ are the reference scan speed and maskant thickness, and $\partial$ is a measure of damage penetration into the paint substrate on the order of 1.0 mil. The above relation allows correction of the scan speed found from FIG. 13 for variation from the reference maskant thickness of 2 mils (at which thickness the testing for FIG. 13 was performed).

For example, with a laser power of 10 Watts, and a spot size of 1.0 mm, the power density is $$PD=(4)(10)/(\lambda)(0.1)^2=1270\ \text{w/cm}^2.$$

From FIG. 13, the corresponding optimum scan speed at the reference maskant thickness of 2 mils is $V_0=3.2$ inches/sec. If the maskant thickness is actually measured as 5 mils, the scan speed must be corrected to $$V_1 = V_0\,(h_0+\partial)/(h_1+\partial) = (3.2)(2+1)/(5+1) = 1.6 \text{ inches/sec.}$$

As the maskant is being cut by the laser, smoke is formed by the burning maskant. Even with strong ventilation, the smoke occasionally billows into the path of the beam, attenuating it and causing a short segment of the stencil outline not to be cut through cleanly. A satisfactory way to remedy this problem is to increase the scan speed and perform two or three cutting passes over the stencil outline. This ensures that any spots that were skipped on the first pass are cut through on subsequent passes.

PROGRAM SOFTWARE OUTLINE

The main user interface screen on the computer monitor is divided into sections including a status area, a graphics area, a comment line, and the menus for starting various routines. The following discussion details the arrangement of the display screen for purposes of illustrating the user interface process with the computer. The arrangement is somewhat arbitrary and other arrangements are equally suitable.

The status area section on the screen provides information to the user in separate subwindows about the current operating mode, name of the loaded scan file, status of any current calibration sequence, figure of merit (FOM) from the latest relative position calculation, and the current location of the laser spot within the field of the scanner.

The available operating modes are MENU, FILE, CALIBRATE, PROJECTING, and CUTTING. The program starts in the MENU mode, which allows the user to navigate through the menu system. The FILE mode is entered whenever the user is loading, saving or manipulating a disk file (scan files or calibration files). The CALIBRATE mode is entered during manual or automatic calibration of either standard 3D reference point arrays or 2-point arrays for speed stripes. Once a scan file has been loaded, and a reference calibration either performed or loaded from disk, the user can select the 'Project' menu to start "projecting" or "cutting" the scan file. This places the system in either a PROJECTING or CUTTING mode respectively.

The name of the currently loaded scan file is displayed in the status area. This field is blank until a file has been loaded.

Another status field shows the number of reference points that have been located for calibration out of the total number of references listed in the scan file (or out of 2 for a speed stripe calibration). The default number of references before a scan file has been loaded is 4.

The Figure of Merit (FOM) field is blank until a scan file has been loaded and a calibration has been completed. Once both of these conditions has been met, the software automatically calculates a vector transformation that performs a least squares fit of the scan file reference data to the measured reference locations on the target, and applies this transformation to the scan file endpoint data. The FOM is a measure of the least square error of this transformation, and therefore of the accuracy of the projected point locations on the target in inches.

The final status information field displays the current position of the scanner galvanometers within their 65536 by 65536 pixel field of view. This information is displayed whether or not the laser is energized. The display does not track with the scanner when the system is in the PROJECTING or CUTTING modes.

A large square section in the upper left part of the screen is provided for the graphics area. This area represents the field of view of the scanner. The field consists of a 65536 by 65536 pixel square. Reference points are displayed here as small numbered red squares in their proper locations as they are found during calibration or loaded from a calibration disk file. In this manner, the user easily can track the calibration process. In addition, once a scan file has been loaded and a calibration completed, the endpoint data from the scan file is displayed in yellow. The graphics area provides a visualization for the user of what will be projected or cut onto the target area relative to the reference point locations.

Just below the graphics area is a single line field for displaying text messages. The software uses messages in this area to provide instructions or information to the user appropriate to the current function being performed.

Several of the program operation modes utilize dialog boxes to display current setup parameters, information data tables, etc. Discussion of each of these dialogs is saved for later sections since their operation varies slightly from one to the next. There are also user entry windows for entering data.

A menu bar is located across the bottom of the screen for providing an indication of which operation mode currently is being run.

The menu system is designed in a tree configuration, so that selection of certain menu choices automatically brings up a menu bar for a submenu. The last active key in most of the menus and submenus is labeled 'Return' or 'Abort', and returns to the next higher menu level from which the submenu was selected. In some cases involving modal dialog boxes, the dialog must be closed by pressing the 'Enter' or 'ESC' key before the menu again becomes active.

The main menu is entered first and it provides top level control of the whole program. From the main menu, any basic setup changes can be made, scan files can be selected and loaded, a calibration can be performed or one can be loaded from disk, and the projecting or cutting modes can be chosen. The projecting mode is disabled until all the prerequisites for projection have been met. The other options available from the main menu are to quit the program and to browse through some information dialogs containing data on the current target calibration and some projection statistics.

The first menu option in the main menu is a SETUP option. Two submenus are available under SETUP. These are General Setup and Scanner Setup, described below. In most cases, the default values for these setup routines are sufficient, but they may be altered, if necessary. Bounds checking is performed on all user-entered parameters.

Selecting General Setup brings up a dialog box displaying current settings. All but one of the five submenus under General Setup have their own submenus for selection of acceptable values of various parameters.

The General Setup submenu allows user selection of the number of reference points. However, once a scan file has been loaded, this option is deactivated.

The General Setup submenu also allows selection of the sensor type. In the preferred embodiment, retroreflective tape button sensors are used. However, other sensor types may be implemented based on the physical requirements of the targets used.

Also in the General Setup routine, the seek rate can be set. The seek rate determines the time delay in seconds between successive calls to the automatic calibration routine during projection of a scan file. Time delay choices can be chosen ranging from 10 seconds to 10 minutes, or no time delay can be chosen, which disables autocalibration entirely.

General Setup also allows selection of Max Figure of Merit (FOM). This is the only General Setup item that should require user input. The max FOM sets the upper limit on the accuracy of the position transformation. If the calculated FOM (and hence the accuracy of the projection) exceeds this limit, the transformation will fail, and the PROJECTING mode will remain disabled.

Within the Scanner Setup submenu, a Projector Setup submenu is provided which, when selected, brings up a dialog box displaying the current settings for operation of the DE2000 driver 100 connected to scanner #1. These settings are only in effect when the program is in PROJECTING mode. There are seven submenus under Scanner Setup and each brings up a user entry window for entry of the desired value. Bounds checking is performed by the program to keep parameters within allowable limits.

The General Scanning Inc.'s DE2000 documentation provides a more detailed description and discussion on how to set these parameters. The defaults are set for optimum high speed projection of an average size file, and should be acceptable in many applications. Larger or smaller than average size scan files will require careful adjustment of these parameters.

The Projector Setup routine provides for selection of the following parameters: step size, step period, scan delay, jump size, jump delay, laser on delay, laser off delay, and scan speed.

The Step Size is an integer in the range 1–32767. Units are LSB's where the scanner's field of view is divided into 65536 LSB's in each direction. The Step Size sets the size of the increments that compose the execution of a vector "lineto" command (called a Next command in the DE2000 manual).

The Step Period is an integer in the range 270–65534 (microseconds). This sets the rate at which the scanners increment. The longer the Step Period, the slower the scanner electronics output the steps that compose the "lineto" and "moveto" (Next and Jump) commands. A "lineto" command directs the cutting laser to the next scan point at a lower, cutting speed, while a "moveto" command directs the cutting laser at a faster, non-cutting speed.

The Scan Delay is an integer in the range 2–65534 (microseconds). This sets the settling time for the scanner to wait before execution of a "lineto" command. The longer and faster the previous vector, the longer this settling time needs to be before execution of the next vector. Jump Size is similar to Step Size, except it is used with "moveto" instead of "lineto" commands. Jump Size is an integer in the range 1–32767. It is normally set significantly larger than the Step Size to make "moveto's" faster than "lineto's". Jump Delay is similar to Scan Delay, except it is used with "moveto" instead of "lineto" commands. Jump Delay is an integer in the range 70–65534 (microseconds). It is normally set larger than the Scan Delay proportionate to the speed ratio of "moveto's" to "lineto's" Laser On Delay is an integer in the range 20–65534 (microseconds). Laser On Delay causes the laser to be turned on slightly after the scanner has begun moving in execution of a "lineto" vector. This is needed since the scanner does not reach its velocity instantly, but ramps up to it with a small delay. Laser Off Delay is an integer in the range 2–65534 (microseconds). Laser Off Delay causes the laser to be turned off slightly after the scanner has completed execution of a "lineto" vector. This is needed because the scanner lags the final endpoint signal from the driver electronics due to the delay caused by the initial ramping process.

Scan speed is inactive until a calibration has been completed and a scan file loaded. This is necessary due to the fact that scan speed in inches per second (ips) is meaningless until the target range is known. Entering the desired ips in the user entry window automatically adjusts the other parameters above to produce an average scan speed across the target at its calculated range.

The Cutting Setup Menu brings up a dialog box displaying the current settings for operation of the DSC driver 102 connected to scanner #2. These settings will only be in effect when the program is in CUTTING mode. Each of the seven submenus under Cutting Setup operates identically to its counterpart in the Projector Setup menu.

General Scanning, Inc.'s DSC driver documentation provides a more detailed description of how these parameters are implemented. They do not have direct applicability to the DSC scanner, but must be implemented in the software to provide a similar effect.

The default settings provide a satisfactory cutting speed for average conditions of maskant and laser power settings. "Average" conditions are probably not often encountered exactly in practice, therefore adjustments will most likely be required for any given actual set of conditions.

The FILE menu provides the capability to load in a scan file from disk using fairly standard file dialog selection methods. Capability is also provided for turning on and off reference points and scanned entities. Whenever the FILE routine is operating, the program is in FILE mode as indicated in the Status area on screen.

Within the FILE menu, a Load File submenu brings up a dialog box containing a list of files that match the current settings of Path and Mask along with their respective sizes in bytes on the disk. This list may be scrolled through using the arrow keys to highlight and select the desired scan file. The current Path and Mask settings are displayed in a header at the top of the dialog box. Also in this header is a field for typing in a file name. File format checking is performed when the file is read in from the disk, and if the proper format is not detected, the file is closed and a message is displayed in the Comment line. If the file was successfully opened and read in the proper format, the file name is displayed in the Status area.

A Change Path submenu allows the default Path setting to be changed. A Change Mask submenu allows the default Mask setting to be changed.

A Select References submenu allows the user to select which (if not all) of the reference points listed in the loaded scan file are to be used for a subsequent target area calibration. This routine is inactive until a scan file has been loaded. If a calibration was previously performed, and the user changes the active reference points, the calibration will be invalidated and must be repeated. In addition, if one or more references are turned off when a calibration is completed and saved to disk, care must be taken when later reloading that Calibration file to go back first and turn off the same references.

Within this submenu, a selector list of the reference point numbers is brought up. This list indicates whether each reference point is ON or OFF and allows the user to make changes. If any of the references are turned OFF, this will be reflected in a reduced reference point total displayed in the Status area on screen.

A Select Entities submenu allows the user to select which (if not all) of the scan entities listed in the loaded scan file are to be projected. Once a scan file is loaded, the entities can be turned ON and OFF (projected or not projected) at any time using this menu choice. A selector list that looks and acts just like the selector list for selecting references is used to display the names and ON/OFF status of each of the entities in the scan field. In addition to the actual projection, the graphics display is also updated to show only the entities that are turned ON.

The CALIBRATE menu provides functions for manual or automatic calibration of target position detectors. The functions allow the program to calculate the position and orientation of the detectors, and thus, the target area in space relative to the scan head by comparison of the measured position detector locations to the reference locations listed in a scan file. A simplified 2-point calibration procedure is used for setting up speed stripe projections. Capability is also provided for saving calibration data to a disk file, and for later loading one of these files back into memory to avoid the need for repeating the manual calibration.

Within the CALIBRATE menu, a Manual submenu is provided. This menu choice turns on the auxiliary laser (via the AOM), and starts a manual calibration sequence in which the user locates each of the reference points on the target area in order. The arrow keys or a mouse/joystick can be used to move the laser spot into the vicinity of the position sensor on the target area. The user then presses either the 'Seek Point' or 'Set Point' function keys (or mouse buttons) described below. The graphics area on the screen provides an indication of the current location of the laser spot within the scanner's field of view whenever the program is in CALIBRATE mode.

Figure 14:
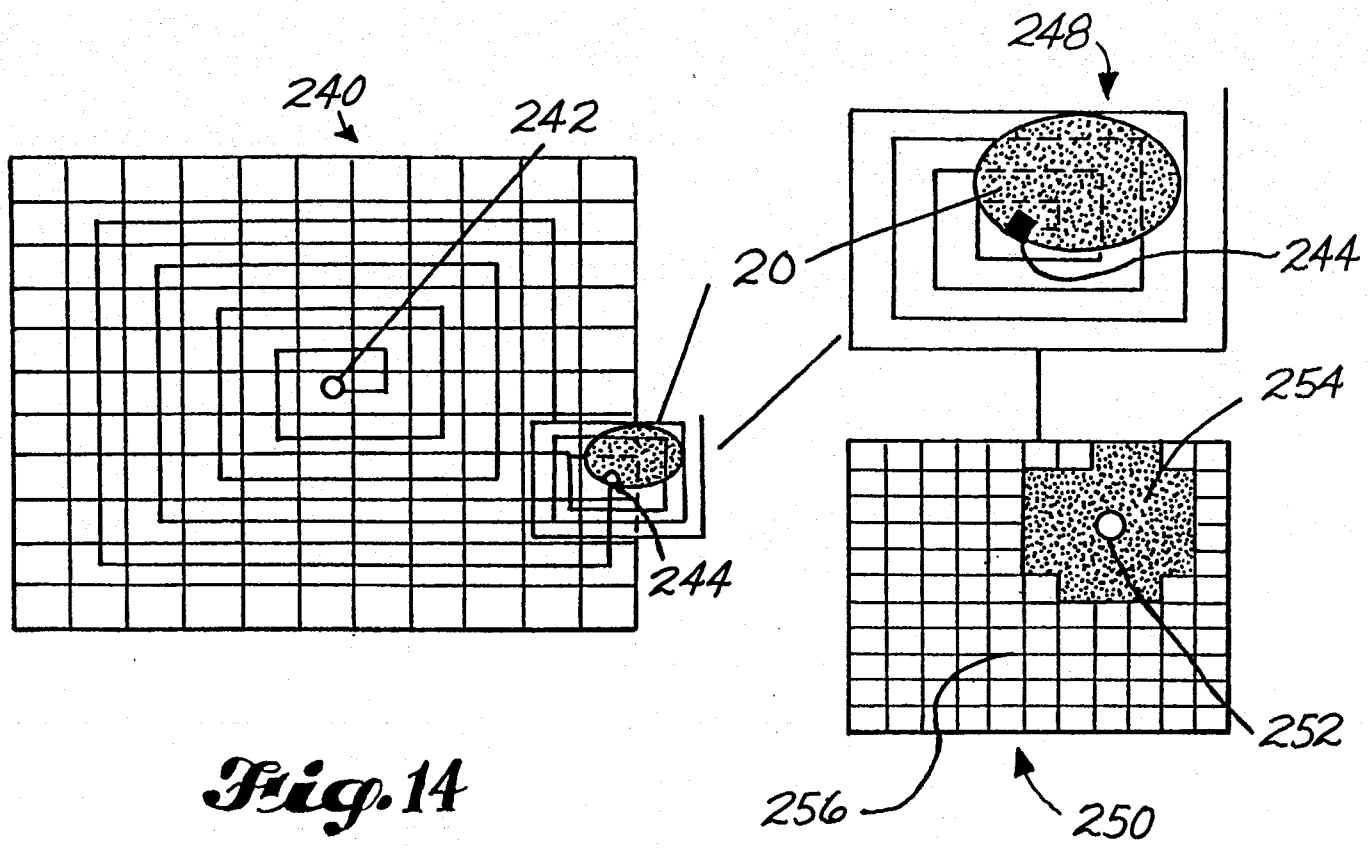
FIG. 14 is a schematic view of the Seek spiral and Centroid spiral routines for locating the center of a position sensor.

A Seek Point subroutine initiates an automatic course grid spiral search for a position sensor in the vicinity of the current laser spot location on the target. If a sensor is found, a finer grid "centroiding" spiral is performed in order to determine the geometric center of the sensor. A Seek spiral is a diverging spiral performed in a square grid centered on the current laser spot location where the Seek was initiated. There is a user-definable maximum number of spirals that will be performed if no sensor is detected. As soon as a sensor is detected (i.e., the return signal measured by the photodiode goes above the set threshold), the Seek spiral is aborted, and the location where the "good" signal was first detected becomes the center of a Centroid spiral. The reference sensor is likely to first be detected at a point on its surface that is not at its center as shown in FIG. 14. To find the center of the sensor, a Centroid spiral is performed, preferably on a smaller, finer grid than the Seek spiral. This spiral will always go to completion unless aborted by the operator. For each point in the grid, the signal level is recorded, and if it is above the Centroid threshold, it is labeled as a "good" return signal. This produces a map of good and bad return signals on the grid as shown in FIG. 14, which should correspond to the location and shape of the sensor. The geometric center of the good return signals on the grid corresponds to the location of the center of the sensor 20 on the target.

A Set Point subroutine bypasses the sensor search and sets the current laser spot location on the target as a reference point. This may be useful during system testing, or whenever the return from a given sensor is too weak to be detected above the noise threshold.

An Automatic submenu is inactive until a calibration sequence has either been completed manually or loaded from a disk file. This submenu initiates an automatic sequence that quickly scans the laser spot to all of the reference point locations on the target to check for a position sensor return. Some sensors may not provide a return due to temporary blockage, etc., but at least four sensors should be found to constitute a successful autocalibration. If one or more sensors are found to have moved more than a certain small threshold distance, any previously-calculated relative target position automatically is recalculated.

A Speed Stripe subroutine is provided when painting a simple stripe. Calibrating for a speed stripe requires locating only two reference points to form a straight line. The two points may be located anywhere on the line, preferably as far apart as possible. The Speed Stripe subroutine sets the number of reference points to 2, and initiates a sequence identical to a normal manual calibration. The reference points may be located similarly either by an automated Seek spiral or by merely setting the desired location. The scan line that is then created extends to the edges of the scanner's field of view, passing through the two reference points. No scan file needs to be loaded in order to project or cut a speed stripe.

A Seek Parameters submenu provides a user adjustment of the parameters controlling the automated Seek and Centroiding spirals performed during position sensor search. A Seek is performed in order to detect the presence and approximate location of a position sensor, and then Centroiding is performed on that sensor to determine the point corresponding to its geometric center. A dialog box is displayed showing the current values of each of the parameters. A user can make changes if necessary.

An Auto Threshold submenu toggles auto-thresholding ON and OFF. The default is OFF, with a low value provided as a default signal threshold for both Seek and Search subroutines. With auto-thresholding OFF, the thresholds may be changed independently within the Seek Threshold and Centroid Threshold subroutines, discussed later. When 'Auto Threshold' is selected, these last two menu choices are deactivated, and an automatic threshold search routine is performed. This search routine looks at nine different points at different quadrants of the scanner's field of view, measures the return signal (which should be low since no position sensors are there), multiplies the average signal by 120%, and sets both the Seek and Centroiding thresholds to this value.

A Seek Threshold subroutine sets the minimum photodiode detector amplifier voltage required to be considered a "good" return from a reference sensor during a Seek spiral subroutine. If this value is set too high, a sensor may not be detected. If it is set too low, spurious sensor readings may be obtained. Use Auto Thresholding if problems are encountered. A Centroid Threshold subroutine is identical to the Seek Threshold subroutine, but applies only during Centroiding spirals. It is normally sufficient to set this identical to the threshold used for Seek spirals.

Other Seek parameters that can be changed include Seek Spirals, Seek Step, Centroid Spirals, Centroid Step, Seek Delay, and Centroid Delay. These parameters control the number of spirals, step size within a spiral, and dwell time for each step for the seek and centroiding spirals, respectively.

A Load Calibration File submenu is provided. Calibration files are created when the user saves a reference point calibration. These files can then be loaded back from disk in lieu of going through a complete manual calibration process for a target/scanner setup that has not moved significantly since the last calibration. The information that is stored in a calibration file consists of the number of reference points and the measured scanner coordinates of each reference point (in scanner LSB's).

If the target has moved more than the size of the seek spirals, the manual calibration will have to be repeated. It is a good idea to perform an automatic calibration before beginning projection of a scan file based on calibration from a disk file in order to fine tune the projection's accuracy. Once a calibration file is loaded, calibration is complete, and this will be reflected in the Status and Graphics areas of the screen, just as if a manual calibration had been performed. A Save Calibration File subroutine allows a user to save the calibration to a disk file.

An INFORMATION menu displays information about the target's sensed position relative to the scan head and some statistics on projection of the currently loaded scan file. Within the INFORMATION menu, a Target Information submenu displays the spatial position in inches of each of the position sensors in the coordinates of the scan head. It also displays the average of all of the range coordinates to give an average range to the target. This submenu is inactive until a target position sensor calibration has been completed.

The scan head coordinate system has its origin at the center of the scanner #2 mirror where the beam makes it final turn toward the target. With the scanner mirrors centered to put the laser spot in the center of the field of view, the y-axis follows the path of the beam perpendicularly out of the scanner. This corresponds to the 'range' axis. The x-axis points horizontally to the right perpendicular to the y-axis when facing out of the scanner toward the target. The z-axis points straight up forming an orthogonal right-hand system.

A Project Information submenu displays the number of endpoints and the number of entities selected for projection out of the totals listed in the scan file. It also lists the scan speed (in inches per second) of the laser spot across the target at the measured range, the time required to complete one projection cycle (in seconds), and the projection's refresh rate (in Hz). Note that the refresh rate is just the inverse of the cycle time. This submenu is inactive until the system is ready to project, including completion of a target reference sensor calibration, and loading of a scan file.

The PROJECTING menu controls the starting and stopping of the laser projection and cutting. This routine is inactive until a target position sensor calibration has been completed, and (if not doing a speed stripe) a scan file has been loaded.

A Start Projecting submenu projects the current scan file onto the target area by turning on the laser beam (with no modulation), and downloading the endpoint data to the driver 100 for scanner #1. The Status Area on screen reflects that the program is in PROJECT mode. If the Seek Rate has some setting other than "None" in the General Setup submenu, automatic reference point searches and, if necessary, re-calibrations are performed at the frequency specified. This routine is inactive while projection is in progress.

A Start Cutting submenu cuts the current scan file onto the target area by sending the endpoint data to the driver 102 for scanner #2. The endpoints that are sent are shifted by the proper amount to compensate for the known relative distance and rotation of scanner #1 to scanner #2. The Status Area on screen will reflect that the program is in CUTTING mode. No automatic reference point searches or re-calibrations will be performed with the cutting laser, so care must be taken not to move the target relative to the projector. This submenu is inactive while cutting is in progress.

SECOND EMBODIMENT

Figure 15:
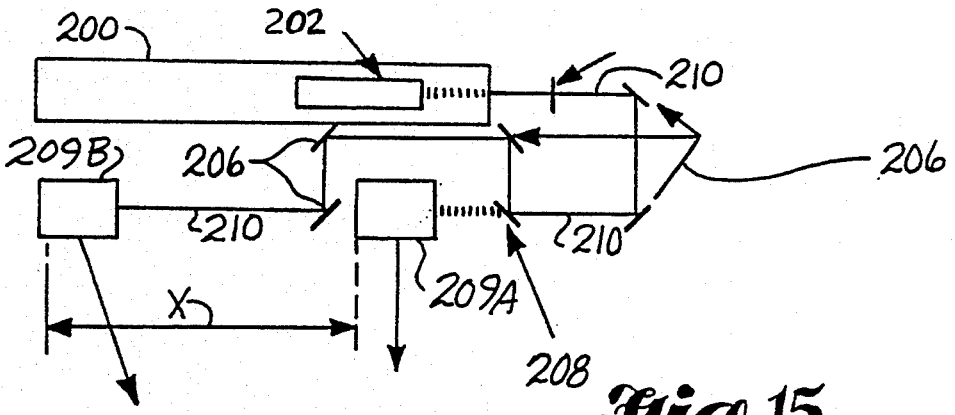
FIG. 15 is a schematic view of a cutting and auxiliary laser and their associated optics of an alternative embodiment for a laser-masking system of the present invention, with the position detectors not shown.
Figure 16:
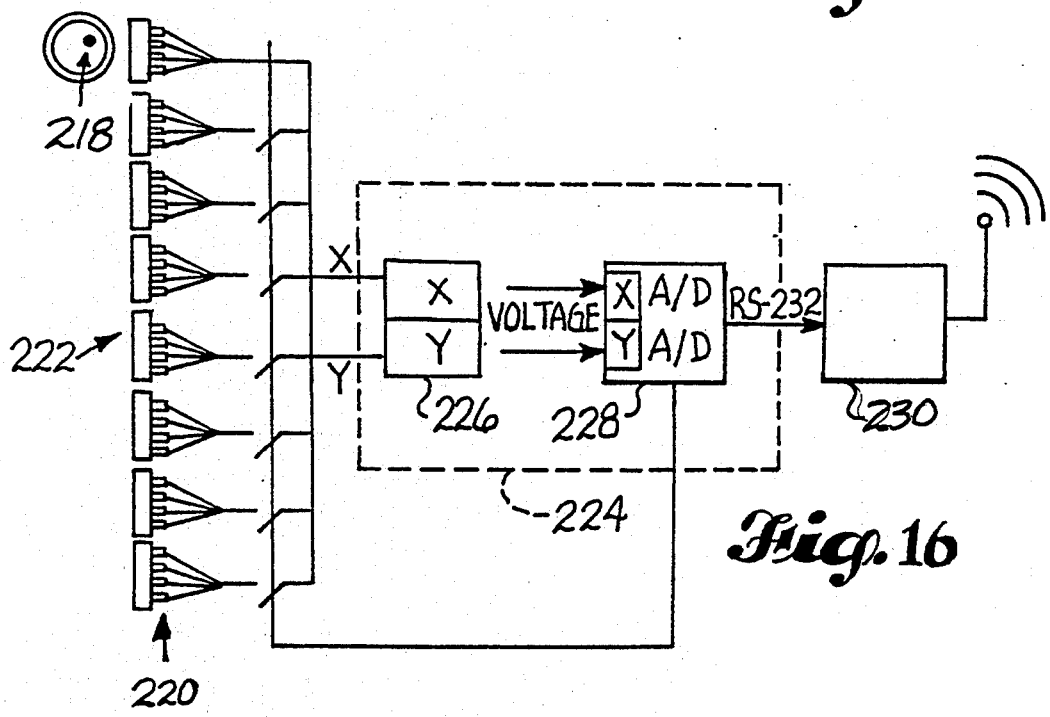
FIG. 16 is a schematic diagram of the position detectors and multiplexor used in combination with the auxiliary and cutting lasers of FIG. 15.
Figure 17:
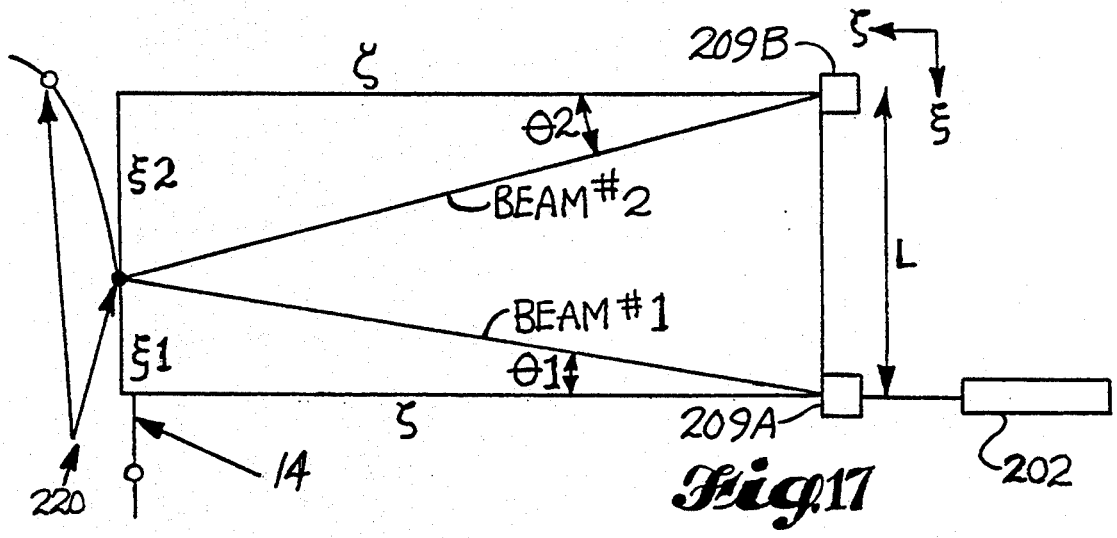
FIG. 17 is a diagrammatic view illustrating the triangulation method of the position-sensing system of the alternative embodiment.

An alternative embodiment for the laser-masking system is illustrated in FIGS. 15–17. This method has a greater degree of error than the preferred method, and, accordingly, is believed suitable for certain 2D applications. A top schematic view of the system components mounted on the mobile cart is shown in FIG. 15. The alternative laser-masking system includes a cutting laser 200, an auxiliary laser 202, an auxiliary laser selector mirror 204, turning mirrors 206, a scanner selector mirror 208, and first and second scanners, as labeled. Generally, the optics and sensors for the alternative system have been modified, while the computer and associated controllers and drivers remain unchanged. The alternative embodiment may include just the different sensors or the different optics or both.

During cutting operations, the cutting laser output is directed into scanner #1. For position sensing, the auxiliary laser 202 output is directed into either of the two scanners via the auxiliary laser selector mirrors 204 and the scanner selector mirror 208. The auxiliary laser selector mirrors 204 are inserted into the beam path 210 with the cutting laser 200 turned OFF in order to direct the auxiliary laser beam into the main beam path. The scanner selector mirror 208 redirects the auxiliary laser beam around scanner #1, into scanner #2, whenever required. The second scanner is used for range triangulation, and is mounted a known distance X from the first scanner along the horizontal x-axis of the scan grid.

In the alternative system, the cutting laser 200 is an Argon-Ion laser similar to the cutting laser of the first embodiment. The alternative system utilizes an off-the-shelf dual-axis scanning system with rotating mirrors attached to thermally compensated galvanometer drive motors, as in the first embodiment. The scanning system also includes either a dynamic focusing lens or a static beam expander (not shown) for changing the focal length while scanning a 3D contoured target.

A diagram of the position-sensing system hardware is shown in FIG. 16. This system takes the position of a laser spot 218 on a position detector or sensor 220 as input and creates a signal proportional to this position as output to drive the spot 218 to the center of the detector 220.

In the alternative embodiment, the position-sensing detectors 220 are "Lateral Effect Photodiodes", about 3 inches in diameter, with a filter placed in front of them in order to block out ambient light and only accept light at the 632 nanometer wavelength produced by the He—Ne laser. In addition to the filter, a lens is placed in front of the detectors in order to accept incident beams at other than perpendicular angles. This minimizes distortion due to refraction errors through the filter.

Each detector 220 produces a set of signals when the laser spot 218 impinges on its active area. The signal level indicates the distance of the spot from the center of the detector. This signal is used by the computer to automatically drive the scanner to center the laser spot on the detector. An array of at least three of these sensors placed around the target area is used by the position-sensing system. An array 222 of eight photo detectors 220 is shown in FIG. 16. the Each detector 220 is mounted in a housing with a suction cup on the back, and crosshairs for accurate placement and attachment to the object (airplane skin).

The signal from each of the detectors 220 in the array 222 is carried by a cable to a multiplexer box 224 placed on or near the airplane. The multiplexer box 224 includes a signal convertor 226 and a microprocessor 228. An RF transceiver 230 in the box communicates with an identical transceiver at the control computer on the mobile cart. Many types of multiplexers are commercially available that are suitable for the present application. Their operation is known in the art and will not be discussed in detail. Generally, the position-sensing software on the computer queries the multiplexer box 224 for the current signal level from a given detector. This causes the multiplexer to switch its input to the requested detector and transmit back the appropriate position signal data to the control computer.

The position-sensing software routines provide the user interface for controlling the scanner to move manually the auxiliary laser beam onto the detectors, and to center automatically the beam on the detectors. They also contain the math routines for range triangulation and scan file transformation.

The system can be equipped with an acousto-optic modulator, as discussed in the first embodiment, whose function it is to dim the beam during times when the beam must move from the end of one scan vector to the start of the next without cutting the maskant.

The position-sensing system of the alternative embodiment uses a range-triangulation method to find the relative position of an array of reference points (detectors), and then performs a linear transformation to convert a scan file for the stencil from a given first coordinate reference frame to a second physical reference frame defined by the detectors.

The linear transformation from a given arbitrary coordinate frame (x, y, z) to the physical coordinates of the surface of the airplane ($\xi$, $\eta$, $\zeta$) is as follows:

$$\xi = c_1 x + c_2 y + c_3 z + c_4$$

$$\eta = c_5 x + c_6 y + c_7 z + c_8$$

$$\zeta = c_9 x + c_{10} y + c_{11} + c_{12}$$

In order to determine the constants $c_1$–$c_{12}$, which comprise the transformation matrix, the array of detectors placed on reference points on the airplane surface should contain a minimum of four detectors. This provides 12 equations for the detector coordinates ($\xi_1$, $\eta_1$, $\zeta_1$), ($\xi_2$, $\eta_2$, $\zeta_2$), ($\xi_3$, $\eta_3$, $\zeta_3$), and ($\xi_4$, $\eta_4$, $\zeta_4$) in the 12 unknowns $c_1$–$c_{12}$. The following matrix equations must be solved:

$$\Delta \cdot \begin{vmatrix} c_1 \\ c_2 \\ c_3 \\ c_4 \end{vmatrix} = \begin{vmatrix} \xi_1 \\ \xi_2 \\ \xi_3 \\ \xi_4 \end{vmatrix} \quad \Delta \cdot \begin{vmatrix} c_5 \\ c_6 \\ c_7 \\ c_8 \end{vmatrix} = \begin{vmatrix} \eta_1 \\ \eta_2 \\ \eta_3 \\ \eta_4 \end{vmatrix}$$

$$\Delta \cdot \begin{vmatrix} c_9 \\ c_{10} \\ c_{11} \\ c_{12} \end{vmatrix} = \begin{vmatrix} \zeta_1 \\ \zeta_2 \\ \zeta_3 \\ \zeta_4 \end{vmatrix} \quad \text{where: } \Delta = \begin{vmatrix} x_1 & y_1 & z_1 & 1.0 \\ x_2 & y_2 & z_2 & 1.0 \\ x_3 & y_3 & z_3 & 1.0 \\ x_4 & y_4 & z_4 & 1.0 \end{vmatrix}$$

Once the constants $c_1$–$c_{12}$ have been calculated for a given airplane relative position and orientation, the (x, y, z) coordinates of any point in the stencil design's scan file can be transformed directly into the corresponding ($\xi$, $\eta$, $\zeta$) point on the actual airplane surface.

The triangulation method used to determine the reference point coordinates on the plane in inches requires that two different perspectives on the target be obtained. To do this, either the scanner or the target must be moved through a known displacement in a known direction to obtain the second perspective. Preferably, the scanner is moved horizontally along a rail in a direction parallel to the incoming beam through a distance that is set under the General Setup menu. Alternatively, it is preferable to use two scanners, separated by a known fixed distance. FIG. 17 shows the horizontal triangulation method which gives the following equations (note the directionality of $\xi$):

$$\xi_2 - \xi_1 = L$$

$$\xi_1 = \zeta \tan \theta_1$$

$$\xi_2 = \zeta \tan \theta_2$$

Where $\xi_1$ and $\xi_2$ are the horizontal coordinates of the point from the first and second perspectives respectively, $\theta_1$ and $\theta_2$ are the corresponding angles to the point from each perspective, and L is the horizontal distance between the two scanner positions for each perspective. The three equations above can be used to solve for the range ($\zeta$) in inches:

$$\zeta = L/(\tan \theta_1 - \tan \theta_2)$$

Note that the scanner does not measure $\theta$ directly; it gives the number of scanner counts the point is away from the origin in a 65536 square grid, corresponding to an angular range of ±20°. In order to convert from counts to degrees, and move the origin to the center of the scan field, $\theta$ is found from the following equation:

$$\theta = (40/65536) \cdot (\text{counts} - 32767)$$

Once the range ($\zeta$) has been found, the $\xi$ and $\eta$ coordinates of the point in inches are found from:

$$\xi = \zeta \tan \theta_\xi$$

$$\eta = \zeta \tan \theta_\eta$$

If the target is flat or has only very slight contour, then the z-dimension adds no useful information to the calculation, and a 2D calculation must be performed.

This merely entails removing the third row and column from the matrix equations above, and the third equation entirely to produce 6 equations in 6 unknowns to solve for $c_1$–$c_6$. In this case, a minimum of three instead of four reference points (detectors) is required. The matrix equations for the 2D case are as follows:

$$\begin{vmatrix} x_1 & y_1 & 1.0 \\ x_2 & y_2 & 1.0 \\ x_3 & y_3 & 1.0 \end{vmatrix} \begin{vmatrix} c_1 \\ c_2 \\ c_3 \end{vmatrix} = \begin{vmatrix} \xi_1 \\ \xi_2 \\ \xi_3 \end{vmatrix} \begin{vmatrix} x_1 & y_1 & 1.0 \\ x_2 & y_2 & 1.0 \\ x_3 & y_3 & 1.0 \end{vmatrix} \begin{vmatrix} c_4 \\ c_5 \\ c_6 \end{vmatrix} = \begin{vmatrix} \eta_1 \\ \eta_2 \\ \eta_3 \end{vmatrix}$$

If more than the minimum number of detectors is used, then subsets of the available set are used to fill the matrix equations above, and the resulting transformation constants are averaged. For instance, in a 3D case with a minimum of four detectors, if 8 detectors are used, then there are 125 possible combinations of 4 out of the 8. So the matrix equations are solved 125 times, and the resulting 125 values each for $c_1$–$c_{12}$ are averaged.

The following table is the format for a typical scan file to draw a square, containing three reference points (detector locations):

| | |
|---|---|
| X125000 | |
| Y125000 | |
| Z132767 | Reference point #1 |
| X235000 | |
| Y245000 | |
| Z232767 | Reference point #2 |
| X345000 | |
| Y335000 | |
| Z332767 | Reference point #3 |
| JX30000 | |
| JY30000 | |
| JZ32767 | Jump to first point at high speed |
| NX30000 | |
| NY40000 | |
| NZ32767 | Scan to point #2 at cutting speed |
| NX40000 | |
| NY40000 | |
| NZ32767 | Continue cutting to point #3 |
| NX40000 | |
| NY30000 | |
| NZ32767 | Continue cutting to point #4 |
| NX30000 | |
| NY30000 | |
| NZ32767 | Continue cutting back to starting point |

The file begins with all the reference points in the format Xnxxxxx, Ynxxxxx, Znxxxxx, where n is the detector number (order is important), and xxxxx is the coordinate on a 65536 ×65536 grid. The z-coordinates for both reference points and scan endpoints are measured in 0.01 inch increments from an origin of 32767. So if a point is 10 inches from zero in the positive z-direction in the stencil design, then the z-coordinate for the scan file is 32767+10/0.01=33767. The stencil design represented by the scan file above is flat, therefore all z-coordinates are at the origin of 32767. The non-contoured (flat) nature of the design is also what allows there to be only three instead of at least four reference points. A 2D transformation will be performed on this scan file.

After the reference points in the file, the scan endpoints are listed in a format similar to that described above. Points beginning with N (next) are scanned at the preset cutting speed, while points beginning with J (jump) are moved to at a much higher speed that will not cut the maskant.

The scan file that is saved on disk contains extra information such as reference points and z-coordinates. This information is stripped out of the version sent to the scanner, leaving only the JX, JY, NX, and NY lines.

In application, the position detectors are positioned accurately on the airplane surface at the reference point locations and affixed using the suction cups on the back. The reference points should be chosen, as in the first embodiment, to correspond with an easily recognizable point on the airplane, such as a certain rivet head or skin lap joint, etc.

Next, the laser scanner mobile cart is moved into the proper position and orientation. Then the computer controller performs the position sensing, scan file transformation, and scanning of the transformed scan file to cut the stencil.

The Scanner Setup routine sets the number of detectors, and the Position Sense routine finds the relative positions of each of the detectors. With the target range determined, the Scanner Setup routine sets the cutting speed and any multiple pass cutting parameters.

Once the Position Sense routine has been completed, the Transform Scan File routine calculates the linear transformation matrix ($c_1$–$c_{12}$) and applies it to the scan file, making it ready for scanning onto the target.

The program for controlling the laser-masking system of the alternative embodiment is similar to the program routines for the first embodiment. The program has the following main menu:

1. General Setup
2. Scanner Setup
3. Position Sense
4. Transform Scan File
5. Send Scan File General Setup allows setting of some basic parameters associated with position sensing and sending of scan files. Scanner Setup allows input of various control constants used by the scanner. It also allows setting of the scan speed in inches per second once position sensing has been completed. Target range from the latest sensed position is used to convert scan speed from angular (°/sec) to linear (inch/sec). In addition, Scanner Setup allows the user to define up to three cutting passes at different scan speeds to be used when a scan file is sent The Position Sense menu choice brings up a graphics screen, which shows the current position of the laser spot within the scan field (a 65535×65536 grid). Header information at the top of the screen gives the current spot coordinates, the number of detectors in the array, and the number of the next detector to be located, among other information. As the user finds each of the detectors, symbols appear on the screen to mark the locations. When all of the detectors in the array have been found, the program calculates the actual physical 3D coordinates of each detector in inches, and returns to the main menu.

The Transform Scan File menu choice only functions after Position Sense routine has been completed. This subroutine compares the current physical coordinates of each of the detectors with the corresponding coordinates for the reference points contained in the scan file. This comparison forms the basis for computing the transformation matrix described in the section on Position Sensing.

The Send Scan File menu choice operates on the scan file that has just been transformed, if one exists, or it will use an untransformed file as requested by the user. The scan file is sent, consisting of vector commands similar to those used by a computer pen plotter to draw the stencil design on the target at the current scan speed setting. Any number of repetitions may be requested, or the scanner can be put into continuous repeat mode, which can be stopped using the reset button on the scanner. Alternatively, a program of up to three cutting passes at different speeds as entered in Scanner Setup may be used to optimize the maskant cutting process.

It can be seen that a method and apparatus are now provided for applying a coating to selected portions of a surface of a structure, which method and apparatus function to create the coating pattern on the surface regardless of the relative positioning of the surface and a cutting laser. Such a method and apparatus provide flexibility in positioning the laser relative to the surface, and eliminate the need for expansive mounting jigs to position the structure with respect to the laser. Also, the large supply of paper stencils utilized to create a variety of designs on different types of surfaces is eliminated, or at least substantially reduced.

It is to be understood that many variations in size, shape, and construction can be made to the illustrated and above-described embodiment without departing from the spirit and scope of the present invention. Some of the features of the preferred embodiment may be utilized without other features. Therefore, it is to be understood that the presently described and illustrated embodiment is non-limitive and is for illustration only. Instead, my patent is to be limited for this invention only by the following claim or claims interpreted according to accepted doctrines of claim interpretation, including the doctrine of equivalence and reversal of parts.

What is claimed is:

1. A method of applying a coating design to selected portions of a surface of a structure, comprising:

applying a maskant to the surface;

positioning a plurality of sensors on the structure around the surface;

positioning a laser at a distance from the surface;

directing a laser beam from the laser to each of the sensors as input to the sensors, and using output from the sensors based on the input to determine the position of the laser relative to the surface;

scanning the perimeter of the selected portions with a laser beam from the laser, including using the determined position of the laser relative to the surface to guide the laser beam, to cut into the maskant around the perimeter;

then, peeling the maskant away from the selected portions; and then, applying the coating to the selected portions.

2. The method of claim 1, wherein the step of using output from the sensors based on the input to determined the position of the laser relative to the surface includes using the output from the sensors to determine the position of the sensors relative to the laser and determining the position of the surface relative to the position of the sensors.

3. The method of claim 2, wherein the step of determining the position of the surface relative to the position of the sensors includes establishing reference point locations on the structure for the sensors, and creating a design map for the coating design, which design map establishes the position of the design map relative to the reference point locations, the design map corresponding to the contours of the selected portions of the surface so that upon placement of the sensors on the structure at the reference point locations, the position of the surface relative to the sensors is known.

4. The method of claim 3, wherein the step of using output from the sensors based on the input to determine the position of the laser relative to the surface further includes the step of transforming the design map for the coating design from a design map relative to the reference point locations to a transformed design map relative to the laser.

5. The method of claim 4, wherein the step of transforming the design map includes performing an iterative resectioning algorithm to determine the position of the laser relative to the surface.

6. The method of claim 4, wherein the step of transforming the design map includes performing a range triangulation to determine the position of the sensors.

7. The method of claim 1, wherein the step of directing a laser beam is performed with a first laser, and the step of scanning the perimeter of the selected portions with a laser beam is performed with a second laser, the second laser being able to generate a more powerful laser beam than the first laser.

8. The method of claim 1, wherein the maskant is adapted to adhere to the surface, yet be peelable from the surface, and to absorb substantially all of the laser beam energy so as to avoid damaging the surface of the structure.

9. The method of claim 1, wherein the laser is substantially mobile so that the laser can be maneuvered about the structure and positioned so that the laser confronts the surface of the structure.

10. A method of painting a design on selected portions of a surface of an object, comprising the steps of:

creating a design map for the design in a first coordinate reference frame, applying a maskant to the surface of the object on which the design is to be painted so that the maskant covers the surface portion to be painted and the immediate surrounding surface area, positioning a laser so that the laser confronts the object, determining the position of the selected portions of the surface in a second coordinate reference frame, directing a laser beam from the laser along the perimeter of the selected portions to cut a stencil for the design in the maskant, peeling the cut sections of the maskant from the remaining maskant to expose the selected portions of the surface to be painted, and painting the exposed selected portions of the object.

11. The method according to claim 10, wherein the step of determining the position of the surface portion of the object includes positioning sensors on the object at known reference point locations and directing a laser beam at each sensor in order to determine the position of the sensors in the second coordinate reference frame.

12. A method according to claim 11, wherein the step of creating a map includes creating a map for the known reference point locations in the first coordinate reference frame, the position of the reference point locations thereby being known with respect to the design map, so that upon determination of the position of the sensors in the second coordinate reference frame, the step of determining the position of the selected portions of the surface in the second coordinate reference frame can be performed.

13. The method according to claim 12, wherein the step of determining the position of the selected portions of the surface in the second coordinate reference frame further includes the step of transforming the design map from the first coordinate reference frame to the second coordinate reference frame.

14. The method according to claim 13, wherein the step of transforming the design map includes performing an iterative resectioning analysis.

15. The method according to claim 13, wherein the step of transforming the design map includes performing a range triangulation to determine the position of the sensors.

16. The method according to claim 10, and further comprising the step of peeling the remaining maskant to leave a design on the surface of the object.

* * * * *

UNITED STATES PATENT AND TRADEMARK OFFICE

CERTIFICATE OF CORRECTION

PATENT NO: 5,436,027

DATED: July 25, 1995

INVENTOR(S): Brad W. Offer

It is certified that error appears in the above-identified patent and that said Letters Patent is hereby corrected as shown below:

Column 1, line 23, "(color $\pi$1)" should be -- (color #1) --.

Column 3, line 24, "Upon determining" begins a new paragraph.

Column 7, line 17, "40" should be -- 40° --.

Column 7, lines 26, 31, 48; column 8, lines 13, 32, 34 and 56; and column 9, line 6, "#1" should be -- #1 48A --.

Column 7, lines 48, 50; column 8, line 24; and column 9, line 6, "#2" should be -- #2 48B --.

Column 9, line 7, "#1" should be -- #1 48A by rigid attachment 73 --.

Column 12, line 22,

" $\phi$ = Angular rotation in ..." should be -- $\varphi$ = Angular rotation in ... --.

Column 12, line 45, "functions of $\Psi$ and $\theta$" should be -- functions of $\varphi$ and $\theta$ --.

UNITED STATES PATENT AND TRADEMARK OFFICE

CERTIFICATE OF CORRECTION

PATENT NO: 5,436,027

DATED: July 25, 1995

INVENTOR(S): Brad W. Offer

It is certified that error appears in the above-identified patent and that said Letters Patent is hereby corrected as shown below:

In column 12, lines 47-67, the following equations:

$$P = \begin{bmatrix} \left[\frac{a}{\sin\gamma} - b\right]\tan\phi - \frac{a}{\cos\sigma} + \frac{a}{\cos\sigma_0} \\ \frac{\left[\frac{a}{\sin\gamma} - a\right]}{\sin\gamma_0}\sin\alpha \\ -\frac{\left[\frac{a}{\sin\gamma} - a\right]}{\sin\gamma_0}\cos\alpha \end{bmatrix}$$

$$B = \begin{bmatrix} -\sin\phi \\ \cos\phi * \cos\theta \\ \cos\phi * \sin\theta \end{bmatrix}$$

where, $\sigma = 45^\circ - \phi/2$ $\qquad$ $\sigma_0 = 45^\circ$ $\gamma = 45^\circ + \frac{\alpha}{2} - \frac{\theta}{2}$ $\qquad$ $\gamma_0 = 45^\circ + \frac{\alpha}{2}$ Should be replaced by the following equations: (on next page)

UNITED STATES PATENT AND TRADEMARK OFFICE

CERTIFICATE OF CORRECTION

PATENT NO: 5,436,027

DATED: July 25, 1995

INVENTOR(S): Brad W. Offer

It is certified that error appears in the above-identified patent and that said Letters Patent is hereby corrected as shown below:

$$P = \begin{bmatrix} \left[\frac{a}{\sin\gamma} - b\right]\tan\varphi - \frac{a}{\cos\sigma} + \frac{a}{\cos\sigma_0} \\ \frac{\left[\frac{a}{\sin\gamma} - a\right]}{\sin\gamma_0}\sin\alpha \\ -\frac{\left[\frac{a}{\sin\gamma} - a\right]}{\sin\gamma_0}\cos\alpha \end{bmatrix}$$

$$B = \begin{bmatrix} -\sin\omega \\ \cos\varphi * \cos\theta \\ \cos\varphi * \sin\theta \end{bmatrix}$$

$$\sigma = 45° - \varphi/2 \qquad \sigma_0 = 45°$$

$$\gamma = 45° + \frac{\alpha}{2} - \frac{\theta}{2} \qquad \gamma_0 = 45° + \frac{\alpha}{2}$$

UNITED STATES PATENT AND TRADEMARK OFFICE

CERTIFICATE OF CORRECTION

PATENT NO: 5,436,027

DATED: July 25, 1995

INVENTOR(S): Brad W. Offer

It is certified that error appears in the above-identified patent and that said Letters Patent is hereby corrected as shown below:

In column 14, line 66, " $\phi$ = arctan" should be -- $\varphi$ = arctan --.

In column 18, line 63, $$PD=(4)(10)/(\lambda)(0.1)^2=1270\ \mathrm{w/cm^2}.$$

should be $$PD = (4)(10)/(\pi)(0.1)^2 = 1270 w/cm^2.$$

In column 21, line 65, "70-65534" should be -- 270-65534 --.

In column 23, lines 51 and 57, after "Seek spiral", insert -- 240 --.

In column 23, line 52, after "laser spot", insert -- 242 --.

In column 23, lines 55, 60, and 62, after "sensor", insert -- 20 --.

In column 23, line 58, after "location", insert -- 244 --.

In column 23, line 59, after "Centroid spiral", insert -- 246 --.

UNITED STATES PATENT AND TRADEMARK OFFICE

CERTIFICATE OF CORRECTION

PATENT NO: 5,436,027

DATED: July 25, 1995

INVENTOR(S): Brad W. Offer

It is certified that error appears in the above-identified patent and that said Letters Patent is hereby corrected as shown below:

In column 23, line 60, after "point", insert -- 244 --.

In column 23, line 62, after "Centroid spiral", insert -- 248 --.
line 63, after "spiral" insert -- 240 --.
In column 23, line 68, "a map of good and bad return signals" should read:
-- a map 250 of good 254 and bad 256 return signals --.

In column 24, line 2, after "geometric center", insert -- 252 --.

In column 26, line 31, after "scanners", insert -- 209a, 209b --.

In column 26, lines 38 and 46, "#1" should be -- 209a --; and also in line 46, "#2" should be -- 209b --.

UNITED STATES PATENT AND TRADEMARK OFFICE

CERTIFICATE OF CORRECTION

PATENT NO. : 5,436,027

DATED : July 25, 1995

INVENTOR(S) : Brad W. Offer

It is certified that error appears in the above-indentified patent and that said Letters Patent is hereby corrected as shown below:

In column 30, line 45, there is a period after "sent".

Signed and Sealed this

Twenty-fifth Day of June, 1996

Bruce Lehman

*Attest:*

BRUCE LEHMAN

*Attesting Officer*

*Commissioner of Patents and Trademarks*